US005636319A

United States Patent [19]

Glucksman et al.

[11] Patent Number: 5,636,319

[45] Date of Patent: Jun. 3, 1997

[54] PORTABLE AND PERSONAL-SIZED WARM AIR HUMIDIFIER

[76] Inventors: Dov Z. Glucksman, 137 Larch Row, Wenham, Mass. 01984; Paul Crowhurst, 44 Hyde Park, Beaconsfield Quebec, Canada, H9W5L8; David Lekhtman, 324 Ste Adolphe Road, Morin Heights Quebec, Canada, JOR1H0; Gabriel Chauviaux, 257 De Lubin Street, Laval Quebec, Canada, H7M4J9

[21] Appl. No.: 483,486

[22] Filed: Jun. 7, 1995

Related U.S. Application Data

[63] Continuation of Ser. No. 154,825, Nov. 18, 1993, abandoned, which is a continuation-in-part of Ser. No. 843,542, Feb. 28, 1992, Pat. No. 5,361,322, which is a continuation-in-part of Ser. No. 606,938, Oct. 31, 1990, Pat. No. 5,111,529, which is a continuation of Ser. No. 287,330, Dec. 21, 1988, Pat. No. 5,014,338.

[51] Int. Cl.[6] ..... F22B 1/28

[52] U.S. Cl. ..... 392/406

[58] Field of Search ..... 392/394, 401, 392/402, 403, 405, 406

[56] References Cited

U.S. PATENT DOCUMENTS

| | | | |
|---|---|---|---|
| 1,756,053 | 4/1930 | Colton | 392/405 |
| 2,182,836 | 12/1939 | Zummach | 392/405 |
| 4,190,052 | 2/1980 | McCarthy | 392/403 |
| 4,752,423 | 6/1988 | Wong | 392/405 |
| 4,810,854 | 3/1989 | Jursich et al. | 392/405 |
| 5,067,169 | 11/1991 | Chiu | 392/406 |
| 5,073,967 | 12/1991 | Marino | 392/406 |

*Primary Examiner*—Teresa J. Walberg
*Assistant Examiner*—Sam Paik
*Attorney, Agent, or Firm*—Kenyon & Kenyon

[57] ABSTRACT

Portable and personal-sized warm air humidifiers for delivering a steam air mixture having a uniform moisture at a temperature that does not cause a sensation of pain. A steam ejector is used to mix the steam from an evaporation chamber with the air entering the humidifier. A difference in the water level between a water supply compartment and the evaporation chamber provides a constant pressure in the evaporation chamber which drives generated steam through a steam nozzle communicating with the steam ejector. The dimensions of the steam nozzle are determined in relation with the rate of steam generation in accordance with steam velocity to effectively eliminate or minimize the noise normally associated with the passage of steam through a nozzle. The invention is also well utilizable in a humidifier having a filter medium to filter particulates from the air notwithstanding the drop in pressure of the air across the filter medium from the outside to the interior of the humidifier. The warm air humidifiers only heat a small portion of water thereby providing a safer humidifier in the event of tipping.

23 Claims, 19 Drawing Sheets

PORTABLE AND PERSONAL-SIZED WARM AIR HUMIDIFIER

This application is a continuation of application Ser. No. 08/154,825, filed Nov. 18, 1993, now abandoned which is a continuation-in-part of U.S. patent application Ser. No. 07/843,542 filed on Feb. 28, 1992, now patented U.S. Pat. No. 5,361,322, which is a continuation-in-part of U.S. patent application Ser. No. 07/606,938 filed on Oct. 31, 1990, now patented U.S. Pat. No. 5,111,529, which is a continuation of U.S. patent application Ser. No. 07,287,330 filed on Dec. 21, 1988 which is now U.S. Pat. No. 5,014,338 issued on May 7, 1991.

BACKGROUND OF THE INVENTION

The invention relates to portable and personal-sized electric air humidifiers, more particularly to an improved warm air humidifier.

Air humidifiers are important in controlling the environment in homes during very dry weather, or in winter whenever outside air of low temperature is drawn inside and heated, causing the relative humidity in the home to be lowered to an uncomfortable degree.

Portable humidifiers are well known in the art, and may be classified in the following paragraphs.

1. Steam generators which comprise a water container and an electric heating element submerged in the water. Safety devices are provided for switching off the current as soon as the water level drops below the heating element. Since a flow of hot steam is blown directly into the room to be humidified, there is always the danger of a person, especially a child being scalded whenever he or she comes into contact with the jet of steam ejected, typically, at a temperature of about 212° F. Furthermore, since all of the water is heated, the container of hot water, when overturned, may cause serious injuries to persons nearby.
2. Porous medium humidifiers generally include a porous medium structure partly submerged in cold water contained in an open vessel and a blower unit drawing air through the porous medium structure. The porous medium may be in the shape of a disc or a dram with part of the medium dipping into the water, which is slowly rotated while air is blown through the portion above the water level, thus carrying humidity into the room. The porous medium may also be in the form of a stationary body adapted to draw water into the upper non-immersed part by capillary action, from where it is carried into the room by air blown therethrough.
3. Ultra-sonic humidifiers generally comprise a container filled with water which is brought to a vibration by high-frequency vibrator means which causes the water to be atomized. An air stream directed onto the water surface carries the mist into the room to be humidified.

The major drawback of both porous medium humidifiers and ultra-sonic humidifiers is that the water staying in the container is not heated to its boiling point as in the steam generator and, is therefore susceptible to the growth of micro-organisms which are subsequently carried by the air stream into the room where it may be ingested by people.

Warm-air humidifiers share the benefits of steam generators in that growth of micro-organisms is forestalled by heating the water to its boiling point. Also, warm-air humidifiers avoid the drawback of hot steam entering the room, since in this type of humidifier the steam is carried into the room as a mist mixed with air, at a temperature to be selected by judiciously choosing the ratio of steam and air.

A typical warm-air humidifier is described in U.S. Pat. No. 4,564,746. It includes a heated evaporation chamber which is enclosed to prevent leakage or damage and a fan adapted for dispersing the generated steam into the room via a cabinet passageway. The evaporation chamber is mounted on tracks which permits it to be slid out of its enclosure for cleaning and servicing. The heating element, which is operationally enclosed in the chamber, is attached to a cover which is likewise movable out of the humidifier cabinet for cleaning and servicing.

Unfortunately, the design of this humidifier is relatively intricate and expensive. The heating element is attached to a movable cover which is provided with flexible tubing and must be moved upwards on vertical tracks to clear the top of the water enclosure, permitting the latter to be slid out sideways. This requires a significant amount of space and cannot be serviced except by a skilled person.

In the present invention, a steam ejector is provided which takes the place of the motor driven blower.

Humidifiers employing the motor driven blowers, such as is found in U.S. Pat. No. 5,014,338 and in patent application Ser. No. 07/606,938 have many benefits and advantages. On the other hand, the use of warm air humidifiers utilizing motor driven blowers have some disadvantages. When used in nurseries and in bedrooms such humidifiers are non-conducive to sleep because of the mechanical and aerodynamic noise associated with motor driven blowers. In addition, the presence of high humidity to which motor shafts are exposed creates rusting problems with binding of the shafts to the bearings often resulting. Obviously, this creates expensive maintenance problems.

Certain criteria are desired in warm air humidifiers to maximize the desirability and efficiency of such devices for the user. One criterion is to maintain the steam-air mixture at a predetermined temperature which ranges between 37° C. and 65° C. (99° F.–149° F.) where the lower end of the range approximates human body temperature and the upper end represents a value at which the steam air mixture still may be brought into contact with a person without the sensation of pain. Another criterion is to provide a uniform mixing of air and steam resulting in an even temperature profile at the outlet grille and avoiding non-uniform degrees of air saturation as well as local recondensation on portions of the grille.

Accordingly, an object of the present invention is to provide an improved and novel non-motor driven warm-air humidifier which utilizes a simple and inexpensive structure and still obtains results equivalent to, or better than, those obtained by humidifiers employing motor driven blowers.

Another object is to provide an improved and novel humidifier which provides for the proper and uniform mixture of steam laden air having the proper ratio of air and steam and substantially uniform temperature profile at the outlet grille.

A further object is to provide an improved and novel humidifier which employs a steam ejector in place of a motor driven blower and which exhibits significantly less objectionable noises than those employing motor driven blowers.

A still further object is to provide a novel and improved humidifier which utilizes a steam ejector tube having a restricted throat portion therein and which is dimensioned and positioned in relation to a steam nozzle in which steam flows at a certain velocity and produces a steam air mixture of the proper saturation and temperature substantially noise free or of minimum noise.

Another object is to provide a novel and improved gravity water-feed humidifier in which the constant pressure to drive the generated steam through a steam nozzle is maintained by a differential head of water existing between the steam generation compartment and the water supply compartment.

A still further object is to provide a compact, self contained, personal-size warm air humidifier having the above advantages.

Further objects and advantages of the present invention will be apparent to one skilled in the art in the following description of the invention and the claims.

SUMMARY OF THE INVENTION

The warm air humidifier of the present invention includes an evaporation chamber in the shape of an inverted cup which is provided with a steam nozzle in its top portion and with an electric resistance heater at its bottom end. In a preferred embodiment, the evaporation chamber is capable of containing only a small volume of water, thus promoting rapid start operation. The open bottom end is immersed in the main compartment of a water supply compartment which also includes a filling compartment supplied with water from a portable jug positioned on a base which includes the water supply compartment. The water supply compartment is kept filled with water to a predetermined level by the jug allowing water to flow into the compartment only as high as the rim of the neck of the jug. The pressure within the evaporation chamber, which is generated by the steam therein, is maintained constant by a differential head which exits between the higher level of the water in the water supply compartment and the lower level of the in the evaporation chamber.

Vertically disposed above the steam nozzle is a steam ejector tube having its lower end in spaced proximity to the steam nozzle, whereby steam from the steam nozzle flows through the steam ejector tube. The tube has a narrow and restricted portion which, in operation, creates as region of low pressure to thereby induce a flow of air within the housing to mix with the steam to produce an air-steam mixture. The present invention takes advantage of certain phenomena as described below.

1. The high velocity jet stream from the nozzle, while flowing through the "still air" in the ejector tube, will cause air next to it to move with it through the exertion of a shear-force. That moving air then will carry along with it the adjacent layers of air particles, which in turn carry adjacent layers until the boundaries of the tube are reached. By properly designing and dimensioning and positioning the relevant components involved, entrainment of air with steam to provide a desired ratio of air to steam and temperature may be obtained.
2. The negative or low pressure created within the steam ejector tube, which is dependent upon the dimensions of the "draft" of the tube, will influence the flow of the air to be treated into the humidifier, especially where provision must be made to overcome the pressure drop occasioned by reason of the air having to flow through a filter medium when the humidifier is to remove particulates from the air to be treated.
3. A "buoyancy" phenomenon is utilized in the present invention. As the steam mixes with the air the mixture becomes warm and humid, thus attaining a specific gravity lower than the surrounding dry cooler air. Consequently, the air steam mixture adds another driving component to the flow of the mixture and rises through the tube to enhance the drawing in of fresh or cool air from the bottom of the tube, much as in the well known "atmospheric hyperbolic" cooling towers.

The present incorporates and utilizes these phenomena to provide a simplified and effective low cost warm air humidifier which minimizes and avoids many of the problems associated with other portable humidifiers, particularly those employing motor driven blowers for mixing air and steam for delivery to a room in which such humidifiers are placed.

DETAILED DESCRIPTION OF THE INVENTION

Figure 1:
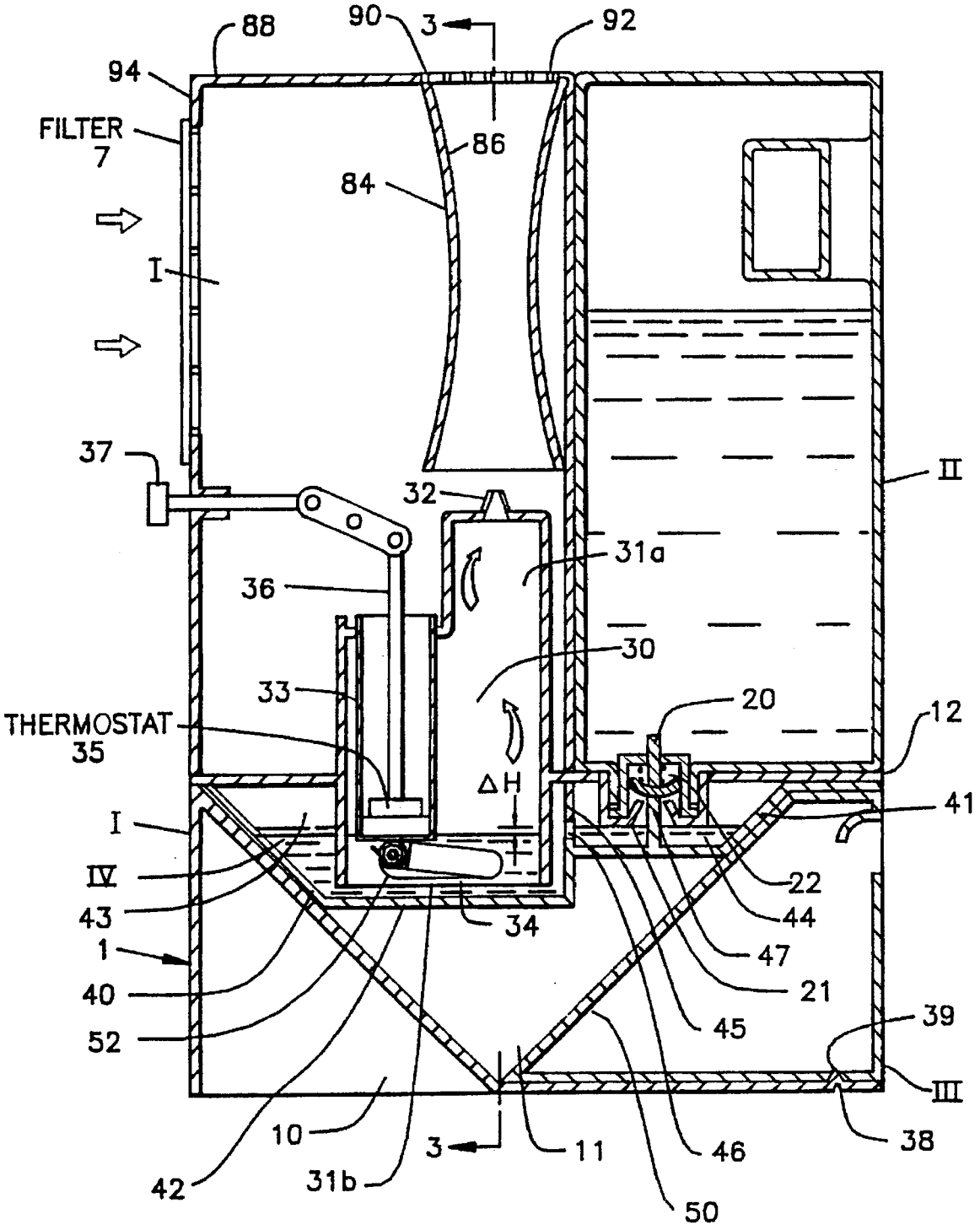
FIG. 1 is a vertical section through the warm-air humidifier of the present invention and through an inverted water container in position on the base means of the humidifier.
Figure 2:
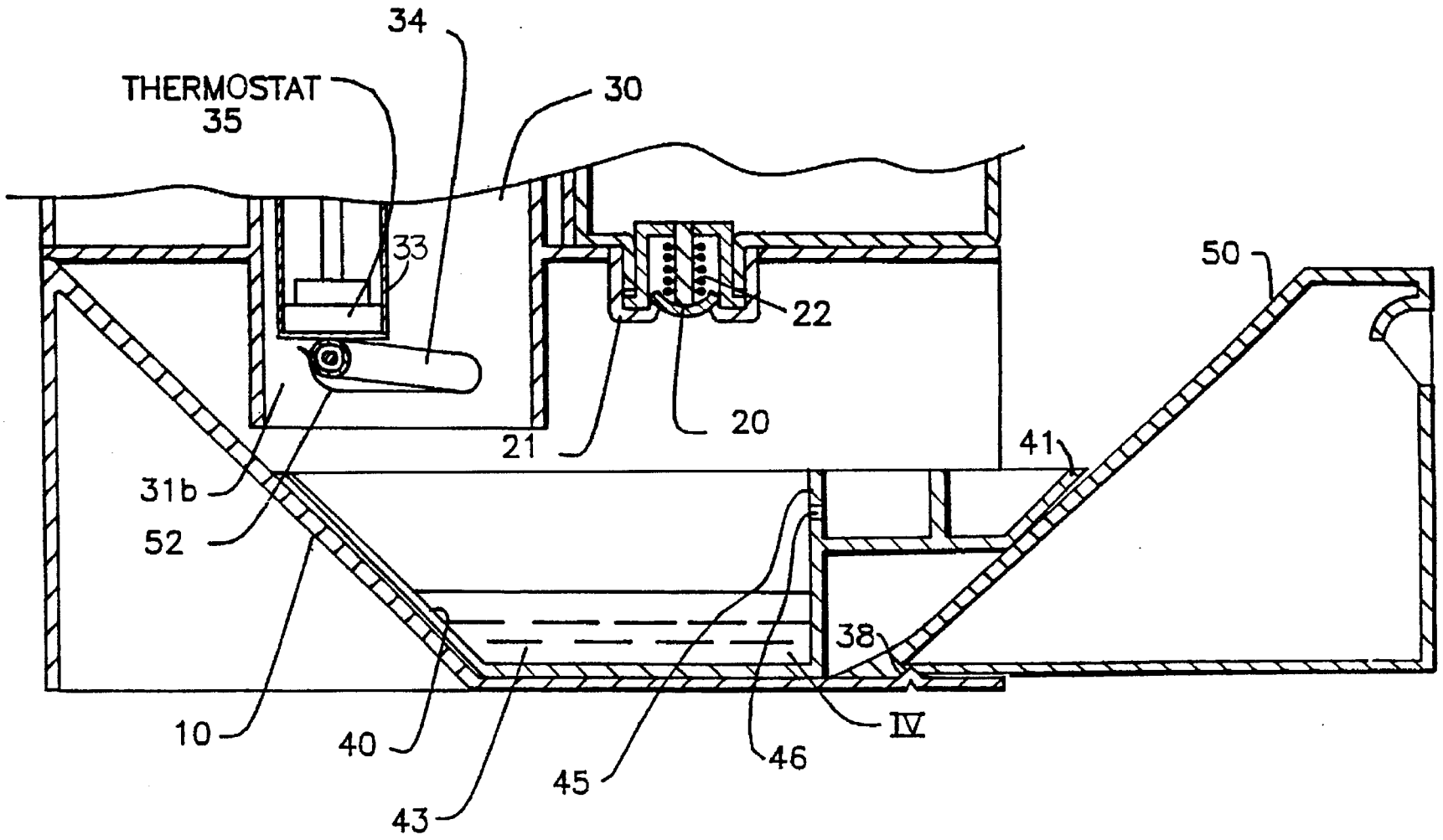
FIG. 2 is a vertical section through the bottom portion of the humidifier illustrated in FIG. 1, showing the tray in lowered position ready for removal.
Figure 3:
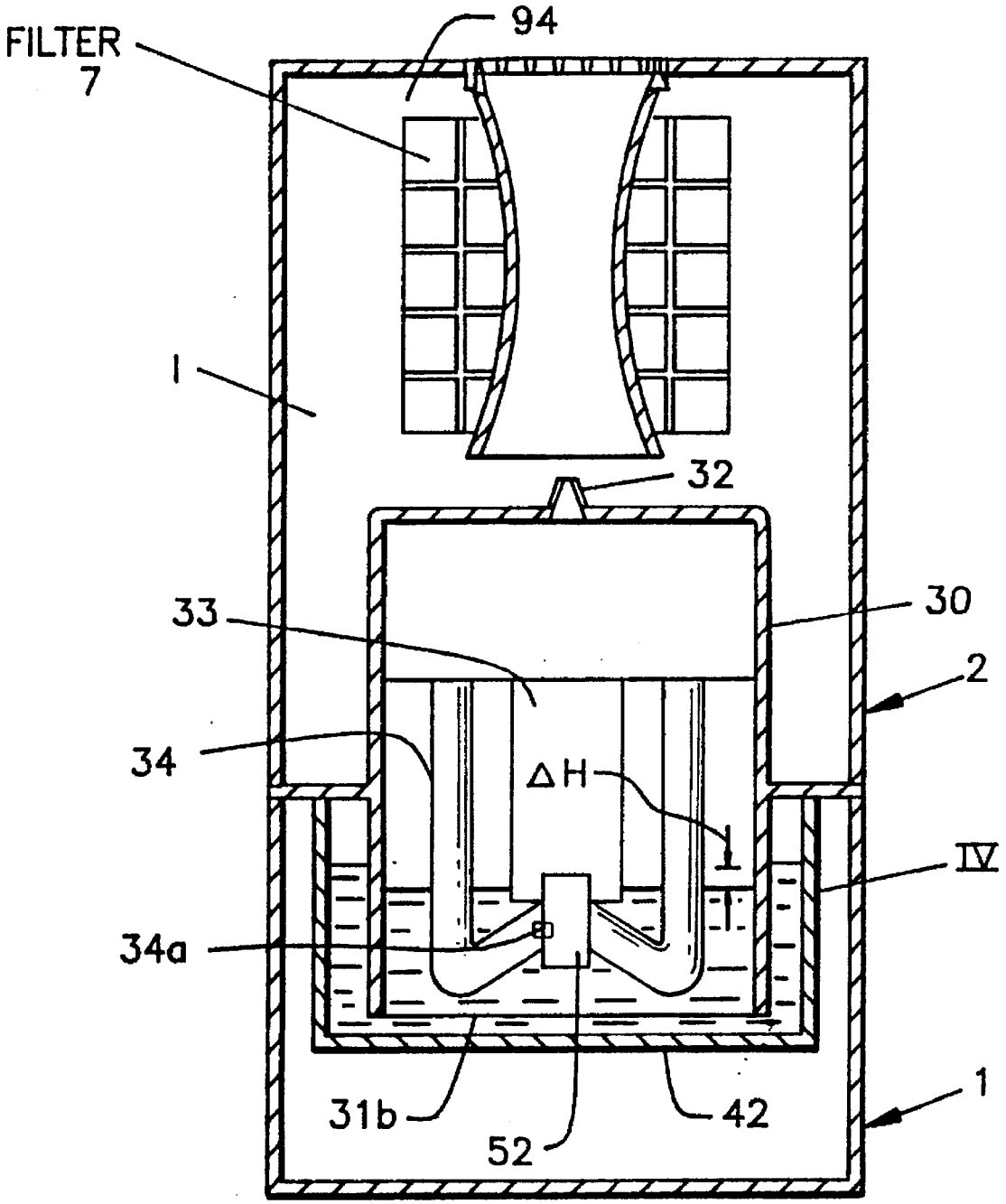
FIG. 3 is a section through the warm-air humidifier along line A—A of FIG. 1.
Figure 4:
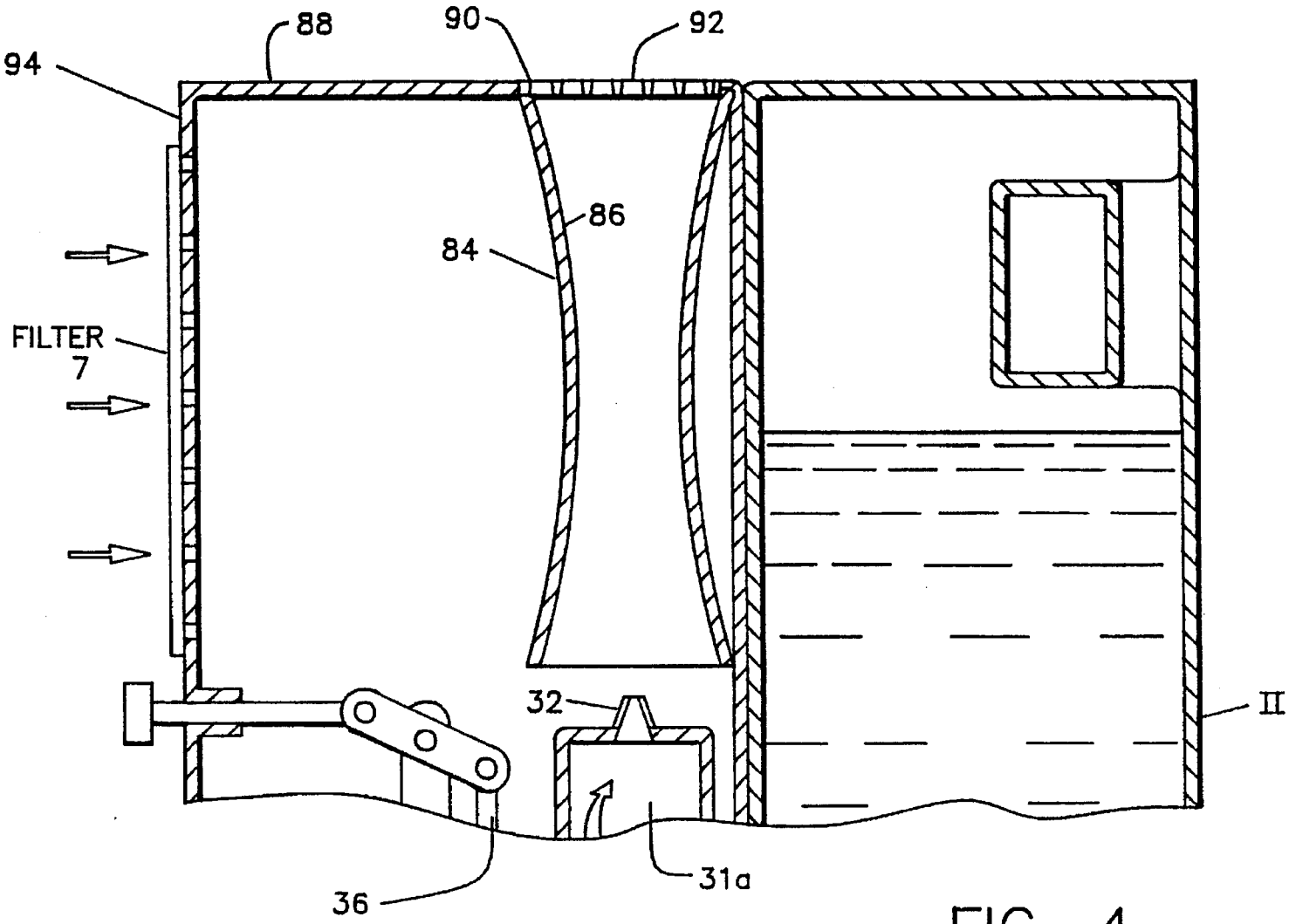
FIG. 4 is an enlarged fragmentary vertical section through the top portion of the humidifier illustrated in FIG. 1.

The components of the warm-air humidifier, as shown in FIGS. 1 and 2, are enclosed in a housing I including a base portion 1 and a top portion 2. The base is configured to support a water jug II in upside-down position. The base contains a drawer III of trapezoidal cross section which forms together with a sloping inner wall 10 of the base, a "V"-shaped trough 11. A tray IV is supported by the respective sloping walls 10 (of the housing) and 50 (of the drawer), whereby the contours of two opposite side walls 40 and 41 of the tray correspond in slope to the inclination of the two walls, while the tray bottom 42 is substantially flat. The tray includes a main compartment 43 and a filling compartment 44, in proximity to the drawer wall 50, which are separated by a partition 45 perforated by a connecting port 46. A vertical pin 47 projects from the bottom of the filling compartment and connects with a spring-supported valve 20 in the neck opening 22 of the inverted jug II. To keep the drawer in position inside the housing, a tongue 38 projects upwardly from the bottom of the housing and engages an opening 39 in the bottom of the drawer when in its closed position.

The top portion of housing 2 includes an evaporation chamber 30 in the shape of an inverted cup which extends into the base portion 1 and into the main compartment 43 of the tray, stopping short of the flat bottom 42 with a narrow gap remaining between the lower rim of the chamber and the bottom. The chamber top is stepped, forming a higher portion 31*a* which contains a steam nozzle 32, and a lower portion 31*b* into which a flask-shaped member 33 is inserted and hermetically closed to prevent steam from escaping therethrough. Member 33 holds a thermostatic switch 35, as well as a set of levers 36 serving for resetting the switch by means of knob 37. The tray, as well as the bottom of the evaporation chamber is filled with water, its upper level being defined by the lower rim 21 of the valve 20 in the neck of the jug 12. An electric heater 34 is fully immersed in the water, and is held at its raised portion 34*a* in intimate contact with the member 33 by means of a clip 52. The heater is switched off as soon as the water level drops below the raised portion 43*a* of the heating element due to lack of water in the jug.

For operation of the humidifier, the jug II filled with water, is placed with its valve 22 onto the filling compartment whereupon the pin 47 urges the valve body 20 upwards off its seat and permits water to flow into the tray. Water flows out of the filling compartment 44 into the main compartment 43 through the port 46 in the partition 45. The level of the water is defined by the rim 21 of the jug's since no air can flow into the jug through the neck when it is covered by water and, obviously no water can flow out.

Due to evaporation, the water level in the tray will drop below the height of the rim of the jug, thereby permitting more water to enter the tray and keeping it fried to the predetermined level. To clean the tray, the drawer III is pulled out of the housing, causing the tray to slide down along the inclined wall 10 of the housing as shown in FIG. 2 of the drawing. At the same time, the pin 47 in the fig compartment is taken out of contact with the valve 20 of the jug, thereby closing the neck opening and preventing water from flowing out into the tray. The drawer III can now be withdrawn from the housing and the tray IV can be taken out.

A vertically disposed steam ejector tube 84 is provided within housing I immediately above the steam nozzle 32. Tube 84 is made of any suitable material and preferably may be formed from a plastic, such as, polypropylene, which is molded to the preferred shape disclosed. At its lower portion tube 84 is flared outwardly and then narrows to a throat 86. From the throat 86, the tube flares outwardly and towards the top 88 of top portion 2 of housing I. top 88 has an outlet opening 90 (FIG. 1), the walls of which seat the circumferential edge of tube 84 at that point. A grille 92 is provided at opening 90 to direct the flow of air from tube 84 and into a room. Housing I may also include side wall 94 having a removable air filter 7.

Since the compartments 43 and 44 are in liquid communication with each other, the water level in both compartments will be the same height. When heating element 34 is energized, the water in compartment 43 and particularly in evaporation chamber 30 begins to boil and steam is formed. The pressure of the generated steam, as present in the space in evaporation chamber 30, forces the level of water therein to a level below the level of the water in compartment 43 outside of evaporation chamber 30 and in compartment 44, to provide a differential head which in effect maintains the pressure within evaporation chamber 30. This pressure forces or drives the steam out of evaporation chamber 30 through steam nozzle 32 at a predetermined velocity. The existing steam then flows up into steam ejector tube 84 where it enters throat 86. The restricted dimensions of throat 86 create a region of low pressure, which in conjunction with other phenomena to be described hereinafter, sucks or draws air in from the interior of housing I to form a steam-air mixture which discharges through outlet opening 90 in the top 88 of the top portion 2 of housing I.

The use of the steam ejector concept in the present invention requires an understanding of certain phenomena which makes practical the application of this concept to gravity feed portable warm air humidifiers. A steam ejector requires a high velocity of steam from a nozzle through an ejector tube to provide a proper mixture of steam and air having the desired ratio, as well as temperature. First, the desired steam velocity should be considered. The velocity of steam through the nozzle is a function of the following:

A=The cross-section area of the nozzle expressed in centimeters squared ($cm^2$);

G=Rate of steam generation in grams per second (GR/sec); and

ρ=The density of the steam in grams per centimeter cubed ($g/cm^3$).

Thus:

$$V(\text{cm/sec})=G\div(\rho\times A)$$

The rate of steam generation is a direct function of the power input:

$$G=K\times EP$$

Where

EP=electric power in watts; and

K=a constant dependent on the latent heat of water.

According to Bernouli's equation, the pressure required to drive this steam through the nozzle at a velocity (V) is $$P+\rho=V2\div 2\ g(g=\text{gravitational acceleration})$$

Applying the foregoing to the present invention, the pressure (ΔP) within evaporation chamber 30, translates to a difference in water level (ΔH) by which the water level in evaporation chamber 30 is lower than the water level in compartments 43 and 44 which supply water to evaporation chamber 30. As will be obvious from the description above, as the water is boiled off in evaporation chamber 30, the water therein slowly recedes. This causes water to seep into evaporation chamber 30 from compartments 43 and 44 and through the space between the lower edges of evaporation chamber 30 and bottom 42 in compartment 43 to replenish the water boiled off. In the structure of the humidifier employed, it is found that the head available is in the range of ½" to ¾" or 1.25 cm to 2.0 cm which furthermore provide steam velocities of 1,000 to 3,000 feet per minute (fpm) or 5–15 meters per second. (m/see). Since an objective of the present invention is to reduce the noise of operation of a humidifier, steam velocities through steam nozzle 32 are maintained below 2,000 fpm, or a rate of steam flow below 0.5 gr/sec $cm^2$ because to go above it would result in objectionable "hissing" sounds.

Figure 9:
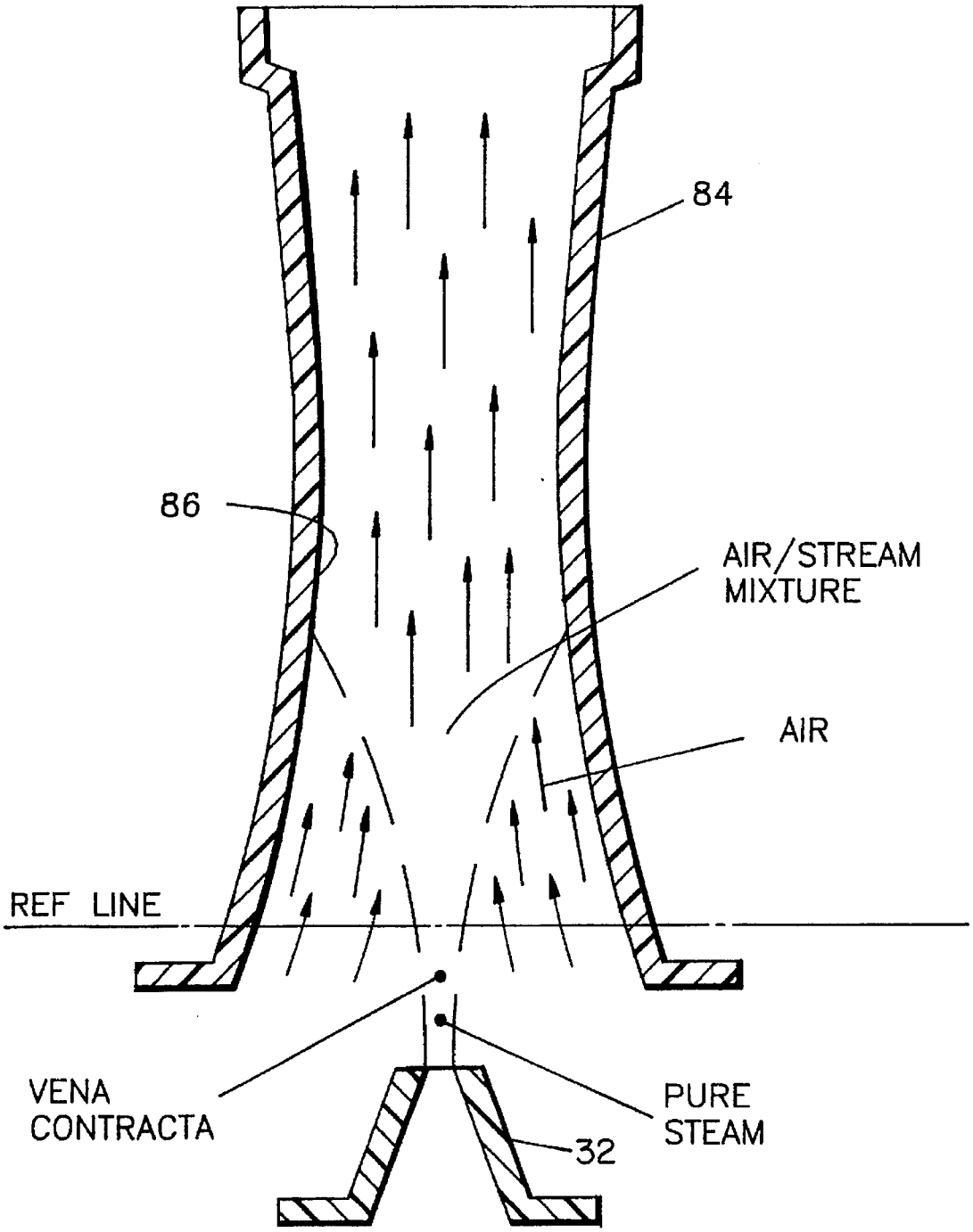
FIG. 9 is an enlarged view of the steam injector tube and of the steam nozzle to graphically show the flowing streams of steam and air.

The action of the steam flow through ejector tube 84 to produce the desired results with the present invention may be explained by reference to FIGS. 9 and 10. In FIG. 9 the steam jet emerging from steam nozzle 32 is at a high velocity and after leaving the nozzle enters an area known as "vena contracta" whereupon it starts diverging. The steam jet while traveling through the "still" air causes the air next to it to move with it through the exertion of sheer-force.

Figure 10:
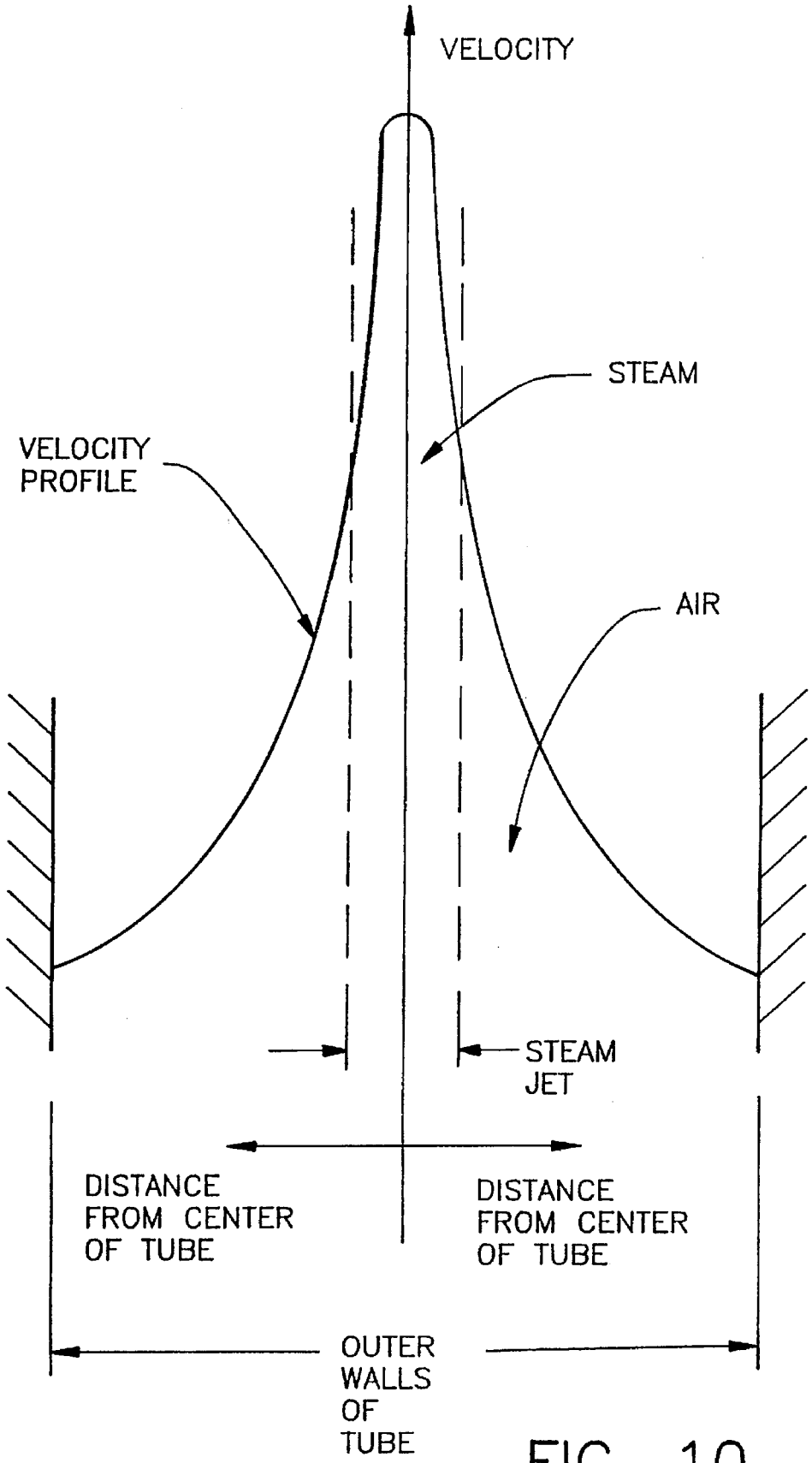
FIG. 10 is a graphical representation of a velocity distribution plot of the phenomena occurring within the steam ejector tube of FIG. 9.

The movement of air next to the steam jet will carry along the air particles next to it, and so on, until a velocity profile as shown in FIG. 10 is achieved. As the steam jet moves further away from the nozzle it expands and entrains the air until a substantially uniform mixture of air and steam is established in and around the narrowest area of the tube, which is the throat As the mixture passes the throat and moves towards the upper end of the tube, the mixture rises due to the upwards impetus provided by the steam and by the buoyancy of the warm, moist air mixture which is lighter than dry cool air.

FIG. 10 illustrates, in a graphic manner, the air and steam velocity distribution as measured along the "ref. line" of FIG. 9. The line described as "velocity profile" is the locus of all the individual velocity measurements taken along the "ref. line" of FIG. 9. It should be noted that along the "ref. line" there is still very little mixing of air and steam and therefore a region of pure steam and pure air can be identified, as pointed out by the terms "steam" and "air".

It was found when constructing the humidifier of the present invention that certain dimensions of the ejector tube 84 had to be adjusted as described below.

As was brought out above, the rate of steam flow out of steam nozzle 32 is preferably maintained below about 0.5 gr/sec $cm^2$. Furthermore, to obtain an outlet moist air temperature between about 42° C. and about 65° C., the ratio between the throat diameter and the distance of throat 86 from the steam nozzle 32 should be in the range of about 0.5 to about 0.75.

Moreover, it was also determined that the ratio of the diameter of the steam nozzle 322 to that of the throat of the ejector tube 84 should be in the range of about 0.1 to about 0.25.

Figure 5:
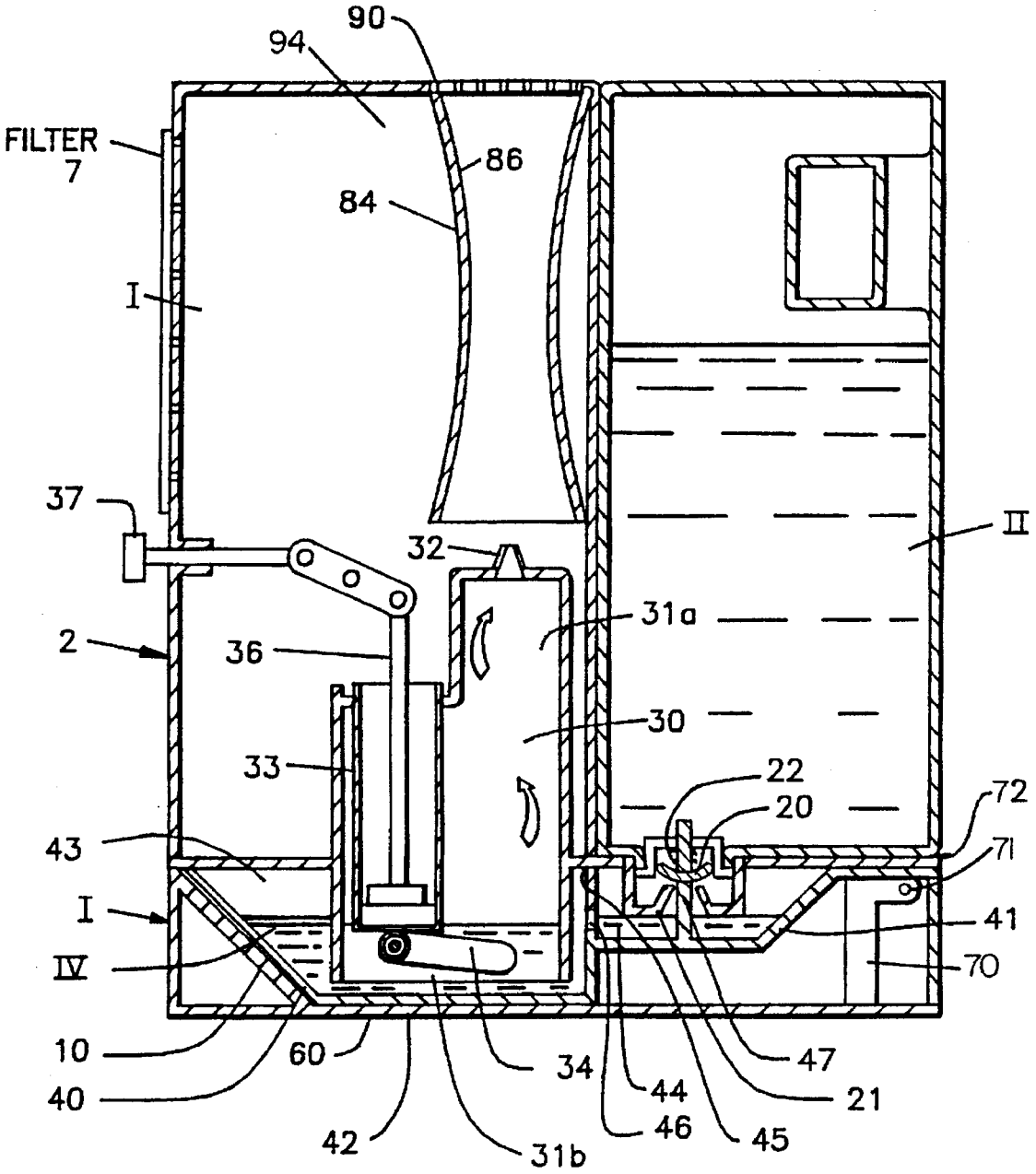
FIG. 5 is a vertical section of a second embodiment of the warm-air humidifier containing a hinged evaporation chamber, shown in position on the base means.
Figure 6:
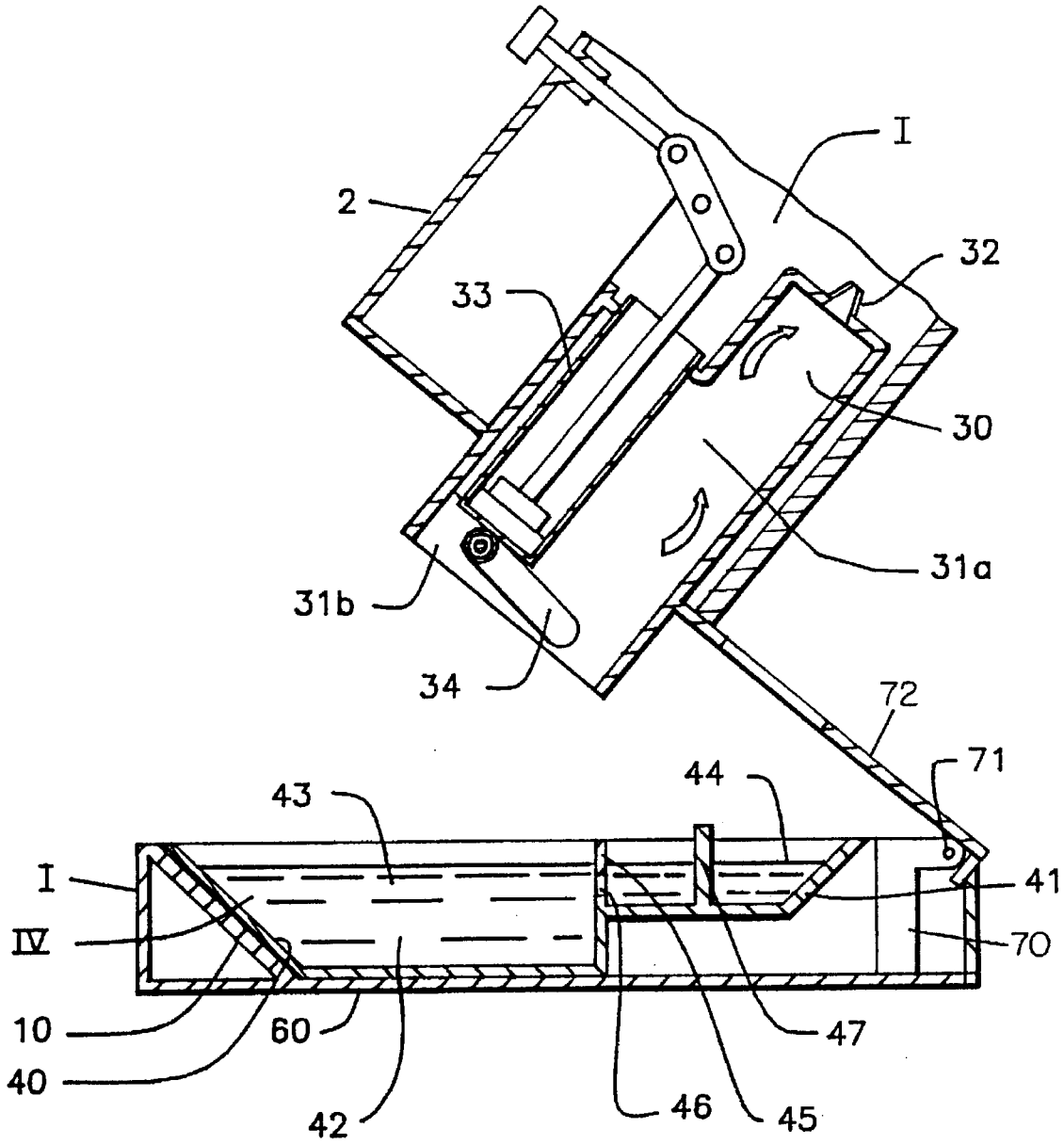
FIG. 6 is a vertical section of the warm-air humidifier FIG. 5 showing the evaporation chamber displaced away from the base means.

FIGS. 5 and 6 show another embodiment of the present invention. In this warm-air humidifier, top portion 2 is hinged, allowing easy access to the tray IV. In FIG. 5, illustrating the resting of the top portion 2 on the base portion I, the lower portion **31*b* of evaporation chamber 30 is surrounded by the tray IV area. A hinge assembly, comprising a hinge 71 and a tinge support member 70, are attached to the jug support platform 72, allowing the top portion 2 of the housing 1 to be moved to an open position, as shown in FIG. 6. These figures also show an embodiment of the invention which does not include a drawer. In this embodiment, base 60 supports the tray bottom 42. When the top portion 2** is moved to its open position, the tray IV is exposed, allowing its easy removal.

Figure 7:
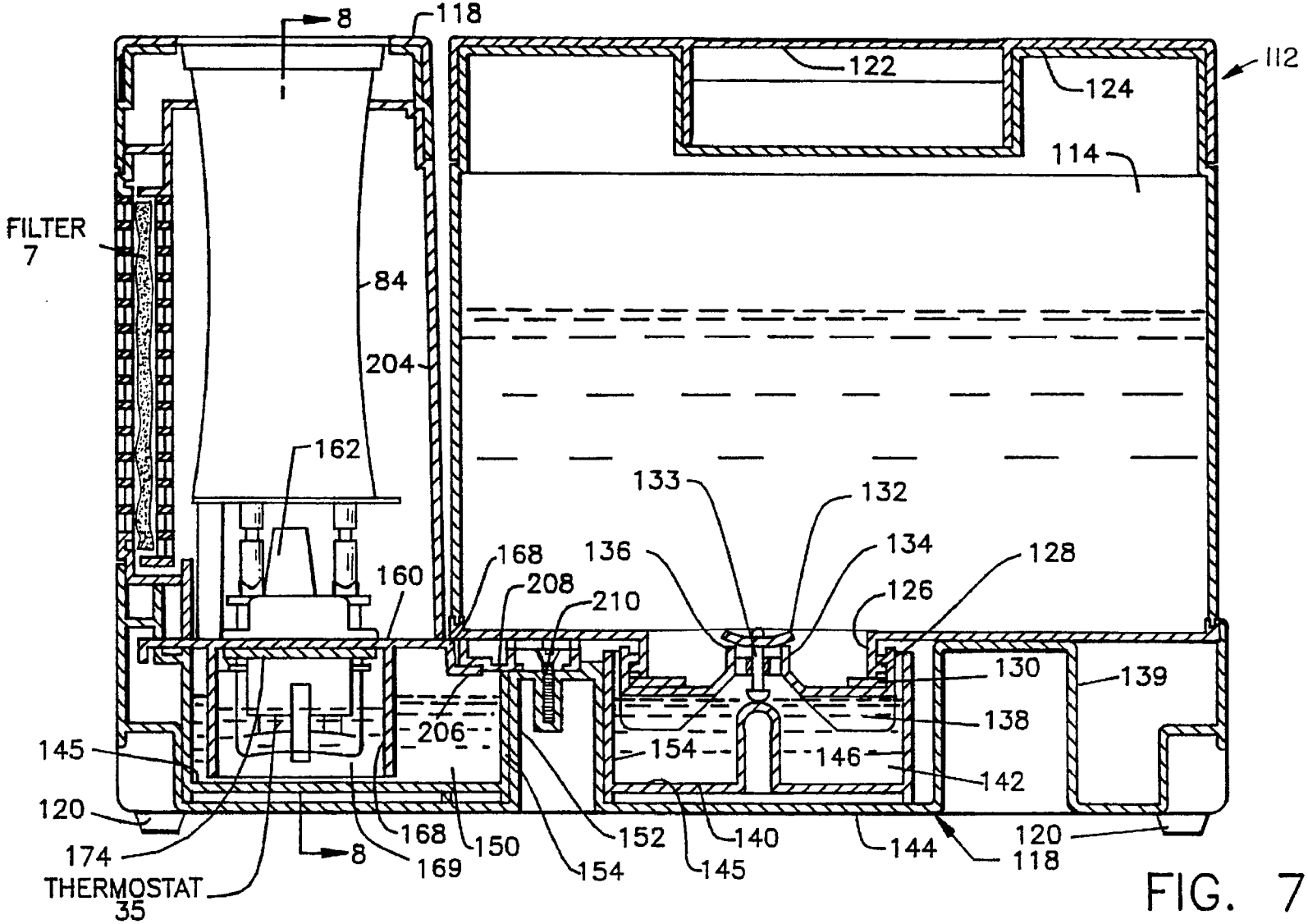
FIG. 7 is a section in elevation, of a third embodiment of the present invention.
Figure 8:
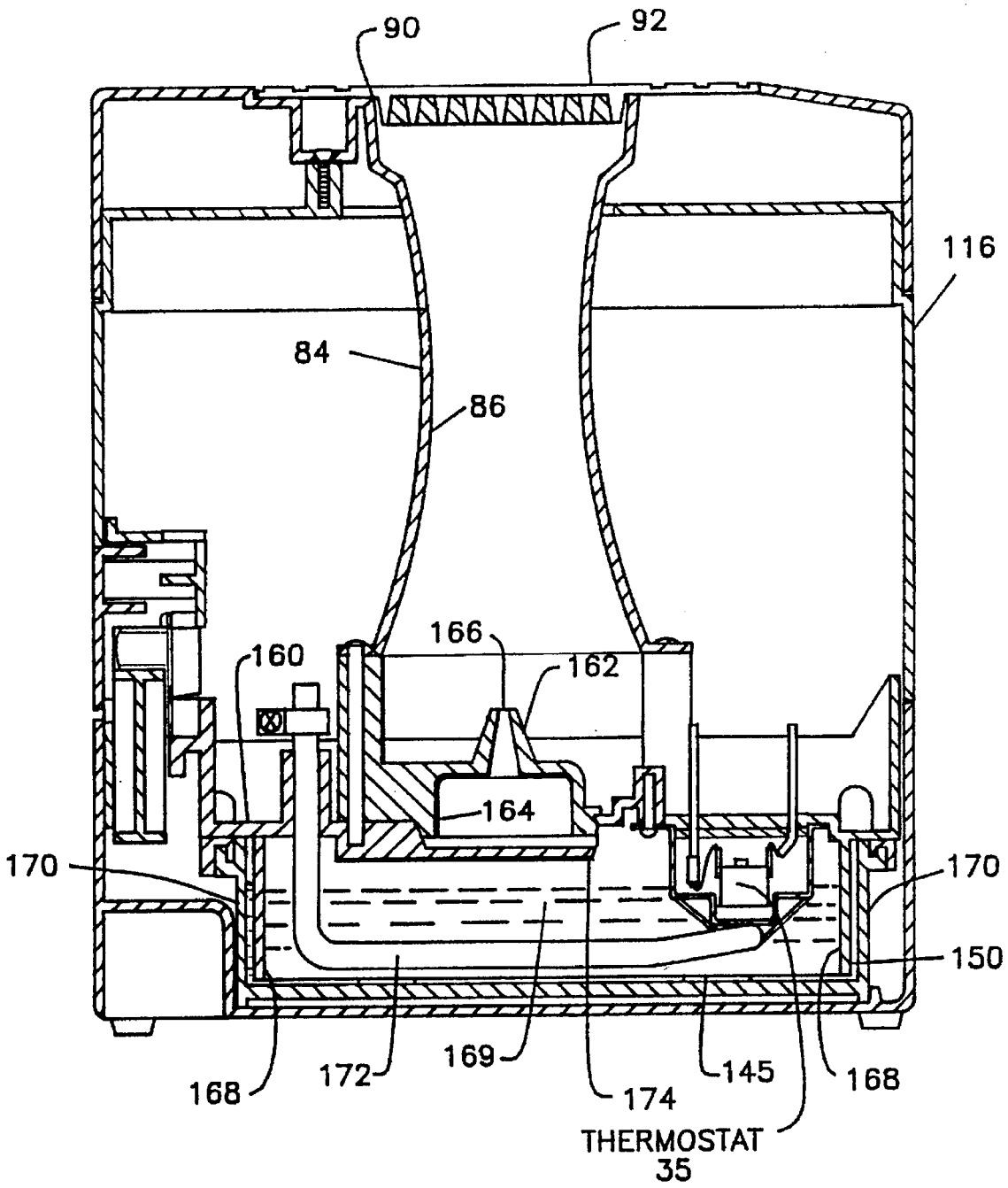
FIG. 8 is a section, in elevation, taken along the line 7—7 of FIG. 7.

A third embodiment of the present invention is disclosed in FIGS. 7 and 8 and incorporates much of the components and concepts found in FIGS. 1 through 6 and FIGS. 9 and 10 except for some slight differences in structure as will become apparent from the following description.

Referring to FIGS. 7 and 9, the portable warm-air humidifier is generally designated by the reference character 112 and includes a water container 114 disposed in juxtaposition with a housing 116, both of which are seated on a base 118 provided with feet 120 for placement on a flat surface (not shown). Water container 114 is provided at its top (FIG. 7) with a convenient handle 122 situated in a recess 124 to permit the manual grasping of the handle 122 to remove and carry the container from base 118. The bottom of container 114, as better seen in FIG. 7, has a neck 126 with external threads on which a cap 130 may be tightened. A spring biased valve 132 (springs not shown) having a valve steam 133 disposed in cap 30 and is normally biased for seating on the walls 134 of an opening 136. Extended wing members 138 are provided to assist in the screwing and unscrewing of cap 130 from neck 126. After the container is fried and capped it is positioned as shown in FIG. 7 where it is supported on base 118 on integrally formed hollow projects supports 139 (one shown in FIG. 7).

Figure 11:
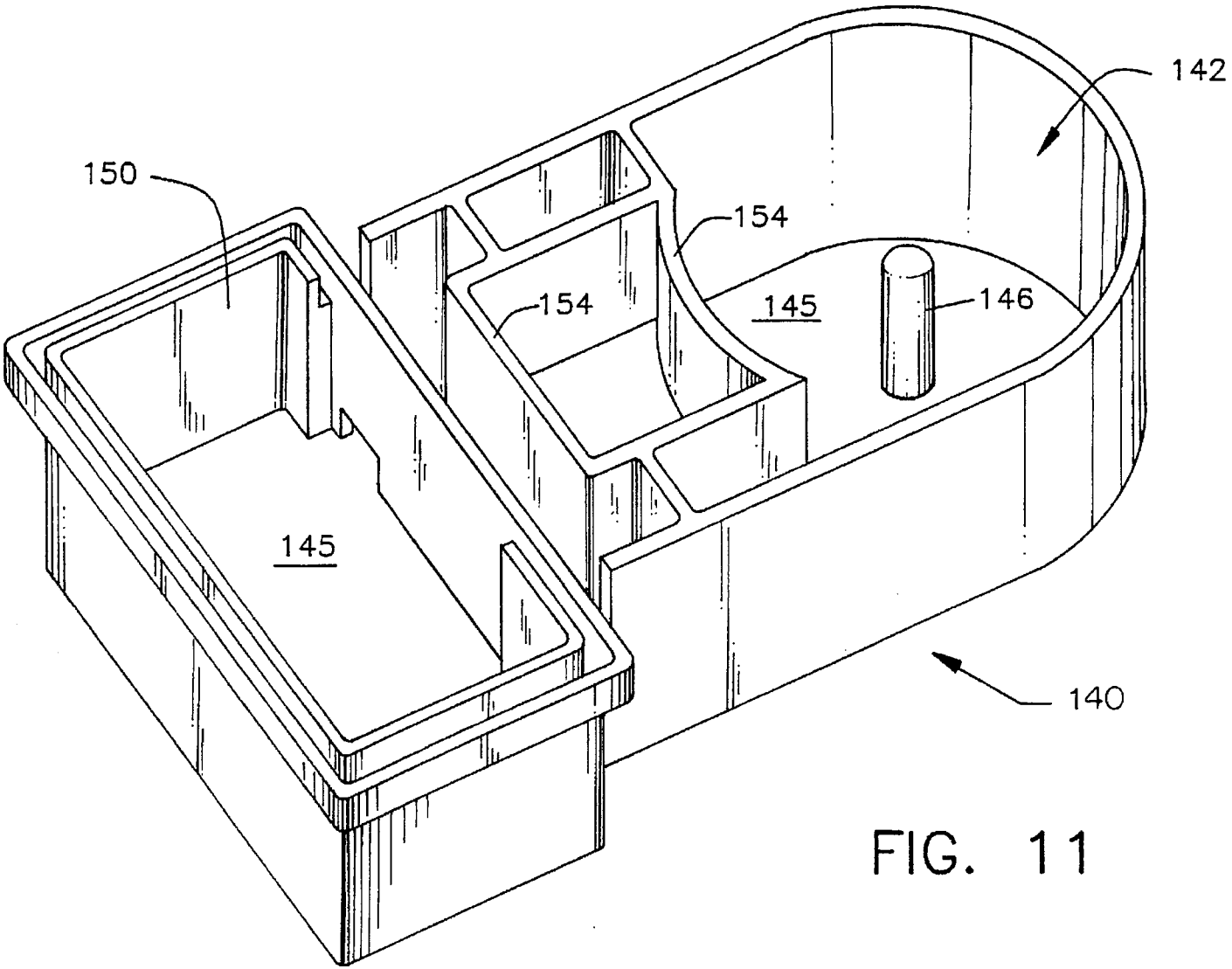
FIG. 11 is an isometric view of the tray shown in FIGS. 7 and 8.

Base 118 is substantially hollow and accommodates a removable tray 140 (shown in FIGS. 7, 8 and 11) resting on a floor 144 of base 118 and the tray has a filling compartment 142 to receive neck 126 of container 114. Tray 140 corresponds to tray IV in the first and second embodiments herein as seen in FIGS. 1–6, in terms of each being easily assessed and removable for cleaning. Furthermore, the trays of each embodiment has a filling compartment and a main compartment. A floor 145 of compartment 142 has an upstanding molded pin 146. As seen in FIG. 7, when container 114 is positioned on base 118, pin 146 engages valve steam 133 to displace valve 132 upwardly, permitting water to flow from the container through opening 136 into a filling compartment 142 of tray 140. Tray 140 has a second or main compartment 150 formed integrally with compartment 142, to the left of the latter as seen in FIG. 7.

An upstanding post 152 is formed integral with floor 144 of base 118 and is positioned between compartments 142 and 150 between upstanding walls 154 of tray 140. Compartment 142 is substantially circular in horizontal cross section to accommodate neck 126 whereas compartment 150 is substantially rectangular in horizontal cross-section. Compartments 142 and 150 of tray 140 are in communication with each other in that water from compartment 142 readily flows therefrom into compartment 150, whereby the level of water in compartment 150 will always be a the level in compartment 142.

Housing 116 is provided with a rectangular shaped floor 160 which substantially seals off the interior of housing 116 from compartment 150 of tray 140 except for an opening in which the lower portion of a steam nozzle 162 is seated. As better seen in FIG. 8, nozzle 162 has an enlarged circular lower portion 164 leading to a narrowed and substantially cylindrical jet opening 166. Floor 160 has, integrally formed therewith, a depending wall 168 which extends perimeterically of the floor and projects downward into compartment 150 of tray 140 to form an evaporation chamber 169. The wall 168 is positioned in close proximity to the walls 170 of compartment 150. The lower edges of wall 168 also extend close to the floor 145 in compartment 150 but are spaced therefrom as to permit water in tray 140, and particularly compartment 150, to readily flow between compartment 150 and evaporation chamber 169.

An electrical heating element 172 is provided in evaporation chamber 169, which when energized, heats the water to boiling to generate steam therein which escapes chamber 169 through steam nozzle 162. A plate or baffle 174 is secured adjacent to lower portion 164 of nozzle 162 and in the path of flow of steam to interrupt and minimize the discharge of water droplets from the compartment with the steam, as well as to muffle to some extent, the boiling sound of water.

The outer sidewalls 204 of housing 116 has an extension of lip 206 which projects below floor 160 and into compartment 150 of tray 140 for engagement by a latch 208 which is mounted on post 152 for pivotal movement by a screw 210. When container 114 is removed from base 118, access may be obtained to latch 208, to pivot it out of engagement with lip 206 to permit the housing 116 to be lifted off of base 118 and thereby allow access to heater element 170 for cleaning and the like.

The present invention as embodied in the third embodiment shown in FIGS. 7 and 8 operates in similar manner as the first two described embodiments in the generation of steam in admixture with air. The humidifier of the third embodiment, as is apparent from the description and explanation hereinbefore, differs in that the housing containing the evaporation chamber may be removed completely from the base whereas in the second embodiment the equivalent structure is pivoted to the base as at 7I (see FIGS. 5 and 6). It is apparent that there is no basic change in concept in that either structure permits displacement of the evaporating chamber from the base to obtain easy access to the heater element. Also, the latching structure which includes latch 208 and lip 206, permits the positive latching of housing 116 on the base 118.

Figure 12:
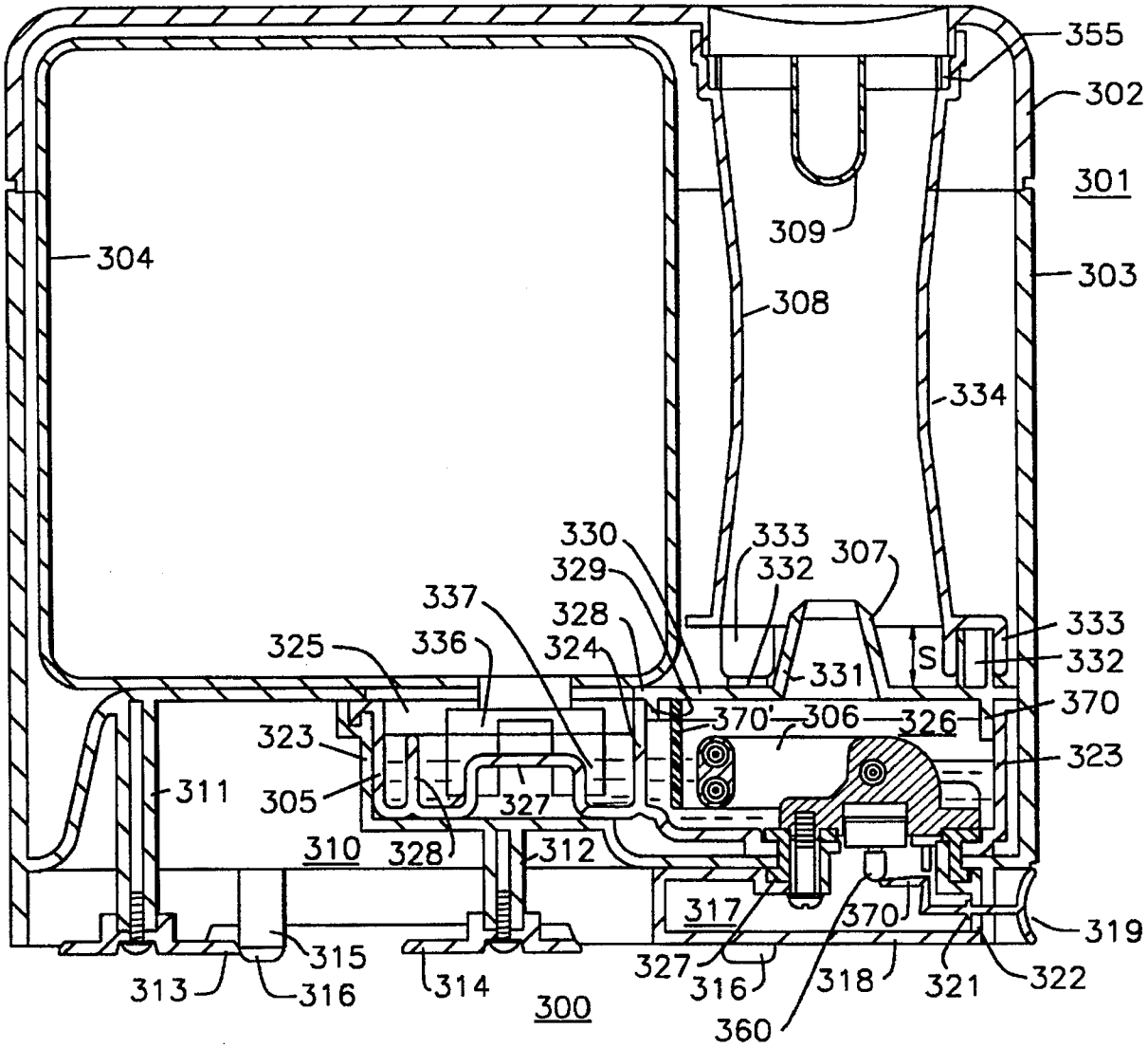
FIG. 12 is a cross-sectional front view of a personal-sized warm air humidifier having a removable water container.

FIG. 12 is a cross-sectional front view illustrating a personal-sized warm air humidifier 300. All of the elements of the personal-sized warm air humidifier 300 are held within a shell 301 which includes a lower housing 303 and a removable upper cover 302. A removable water storage container 304, a tray assembly 305, a heating element 306, a steam nozzle assembly 307, a steam ejection tower or venturi nozzle assembly 308, and a medication cup assembly 309 are accommodated within the shell 301.

A recess 310 is defined by the bottom contour of the lower housing 303 of the shell 301. A pair of posts 311 and 312 project down from the recess 310. A pair of plate elements 313 and 314 are fastened to the ends of the posts 311 and 312, respectively, with fasteners such as screws, for example. The assembly of the posts 311 and 312 with the plate elements 313 and 314, respectively, permits a power cord (not shown) to be wound and conveniently stored within the recess 310. At least one foot post 315 also projects down from the recess 310. An end of the foot post 315 is provided with a foot element 316 composed of rubber for example.

An overheat shut-off resetting assembly 317 is fastened to a bottom section of the lower housing 303, with a suitable means such as screws, for example. The resetting assembly 317 includes a floor 318. One or more foot elements 316 may be provided on the outer surface of the floor 318. The resetting assembly 317 also includes a plunger 319 which has a sloped surface 320. The plunger 319 is biased outward by a suitable means (not shown). A stop element 321 formed on an arm of the plunger 319 engages a blocking surface 322 to limit the outward movement of the plunger 319. The operation of the resetting assembly 317 will be described in more detail below.

Figure 17:
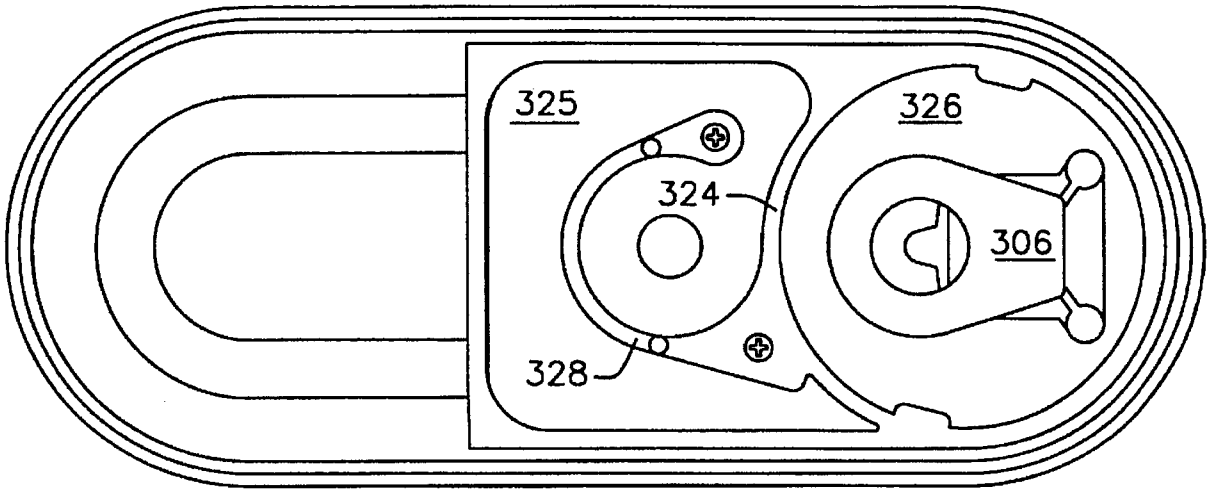
FIG. 17 illustrates a top view of the personal-sized warm air humidifier of FIG. 12 with the cover removed and with the removable water storage container removed.

The tray assembly 305 is fitted, in a sealed manner, into a void defined in the bottom of the lower housing 303. A top view of the tray assembly 305 within the lower housing 303 is illustrated in FIG. 17. The tray assembly 305 includes an outer peripheral wall 323 and an full length dividing wall 324. The dividing wall 324 defines a filling compartment 325 and an evaporation compartment 326. A valve contact element 327 projects up from a floor of the filling compartment This element actuates a valve element of the removable water storage container 304 in a manner described below.

A wall 328 defining a lengthened water channel is formed between the dividing wall 324 and an outer peripheral wall 323. The water channel lengthening wall 328 has a height which is shorter than that of the dividing wall 324. A first end of the water channel lengthening wall 328 abuts and is sealed against the dividing wall 324 while a second end of the water channel lengthening wall 328 defines an opening between it and the dividing wall 324.

A void (not shown) defined in a lower portion of the dividing wall 324 permits fluid communication between the filling compartment 325 and the evaporation compartment 326 of the tray assembly 305.

A floor of the evaporation compartment 326 is arranged below the floor of the falling compartment 325, i.e., the evaporation compartment 326 is formed deeper than the filling compartment 325. A heating element 306, such as an electric heater, for example, is fitted in a void in the floor of the evaporation compartment 326. A water-tight seal 327 is provided between the heating element 306 and the floor of the evaporation compartment 326.

Figure 23:
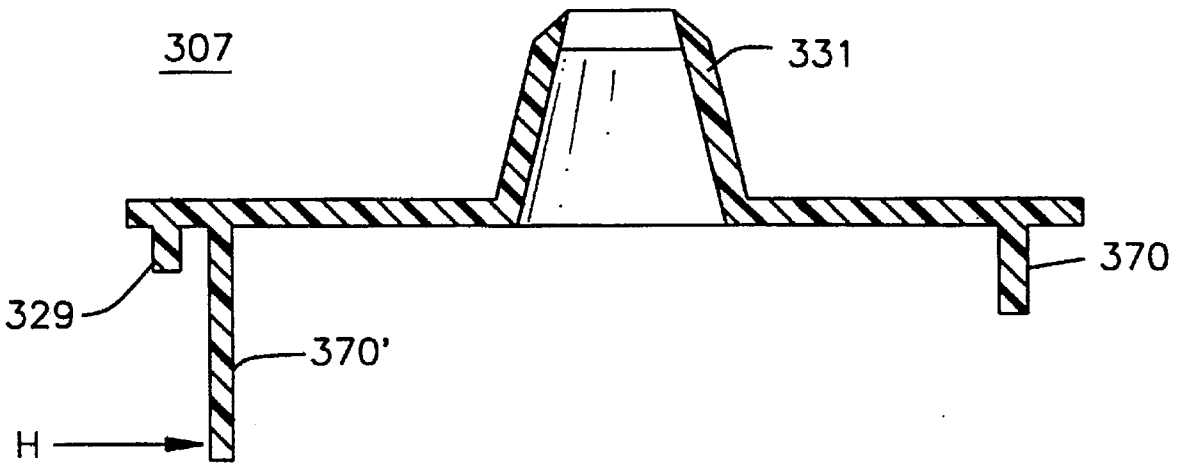
FIG. 23 illustrates a cross section of the steam nozzle assembly of the personal-sized warm air humidifier of FIG. 12.
Figure 24:
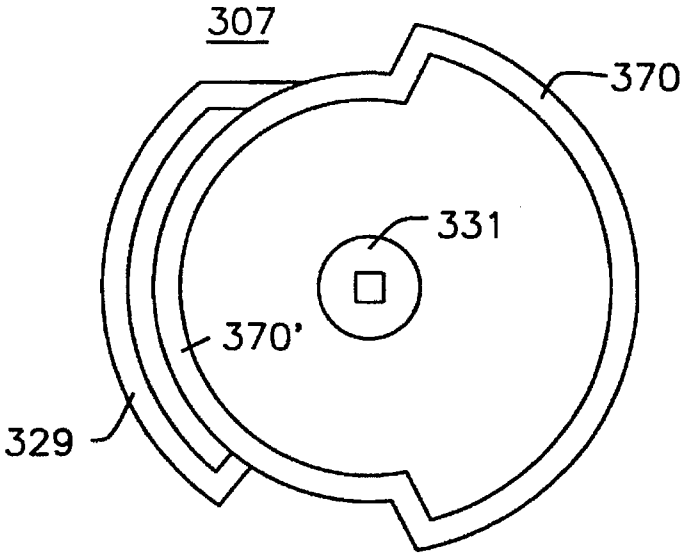
FIG. 24 illustrates a bottom view of the steam nozzle assembly of the personal-sized warm air humidifier of FIG. 12.

The steam nozzle assembly 307 is provided above the evaporation compartment 326 thereby defining an evaporation chamber. The steam nozzle assembly 307 includes a downward projecting lip 329 fitting against an inner surface of the outer peripheral wall 323 and the dividing wall 324 at a first area, and an outwardly projecting flange 328 fining against a top edge of the outer peripheral wall 323 and the dividing wall 324. The steam nozzle assembly also includes a downward projecting skirt 370 which fits against an inner surface of the outer peripheral wall 323 on at a second area. A lengthened section 370' of the skirt 370 projects perpendicular to the dividing wall 324 and is disposed in front of the void defined in the dividing wall 324. FIGS. 23 and 24 more clearly illustrate the skirt 370 and the lengthened section 370' of the skirt 370. The letter "H" in FIG. 23 indicates the approximate location of the void defined in the dividing wall 324. As will be described below, the lengthened section 370' of the skirt 370 prevents pulses of hot water "slugs" from entering the filling compartment 325.

The steam nozzle assembly 307 and the tray assembly 305 include means permitting the steam nozzle assembly to be, rotated and locked-onto, or snapped-onto, the tray assembly 305. A planer portion 330 of the steam nozzle assembly 307 forms a ceiling of the evaporation chamber. A tapered wall extending up from a void defined in the planer portion 330 defines a steam nozzle 331. The wall defining the steam nozzle 331 includes an upper opening and a lower opening. The upper opening is centered above the lower opening and is smaller than the lower opening. The wall defining the steam nozzle 331 gradually tapers from the lower opening to the upper opening.

Each of the upper opening and the lower opening may be any one of many geometric shapes such as a circle, a square, a pentagon, an octagon, etc. In a preferred embodiment, the steam nozzle 331 has a conical shape. In a more preferred embodiment, the upper opening is shaped as a square rather than a circle. Condensation droplets may form on the top of the upper opening of the steam nozzle 331 and at least partially block the upper opening. Providing the steam nozzle 331 with a circular upper opening tended to exacerbate this problem. The sharp edges of a square upper opening of the nozzle 331 minimize such droplets by creating areas of increased surface tension. At least one positioning post member 332 projects up from the planer portion 330 of the steam nozzle assembly 307.

The planer portion 330 of the steam nozzle assembly 307 may include a recess pitched toward the filling compartment 325 and having a void permitting fluid communication between the steam nozzle assembly 307 and the filling compartment 325. This permits any condensed water to flow back into the filling compartment 325.

The steam ejection tower assembly 308 is fitted above the steam nozzle assembly 307. The steam ejection tower assembly 308 includes at least one positioning hole 333 into which the at least one positioning post 332 of the steam nozzle assembly fits, thereby assuring that the steam ejection tower assembly 308 is correctly situated above the steam nozzle assembly 307. The positioning hole 333 and post 332 also define an air intake space or mixing chamber "s" between the planar portion 330 of the steam nozzle assembly 307 and an intake of the steam ejection tower 308. An appropriate means, such as a latch and catch pair, are provided on the steam ejection tower assembly 308 and the steam nozzle assembly 307 to positively lock the two members.

The steam tower assembly 308 includes a substantially "hour-glass" shaped wall 334 defining an intake opening on the bottom and an outlet on the top. The medicine cup assembly 309 can be held in a recess 335 in the top of the hour-glass shaped wall 334 near the outlet.

Figure 22:
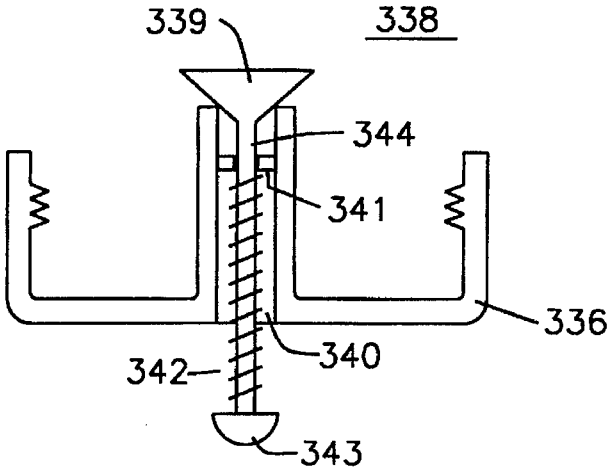
FIG. 22 illustrates a cross section of a cap and valve assembly of the removable water container of the personal-sized warm air humidifier of FIG. 12.

The removable water storage container 304 includes a cap 336 having downward projecting positioning members 337. The positioning members 337 center the cap above the valve contact element 327 of the tray assembly 305. The cap 336 also includes a valve assembly 338 (shown in FIG. 22). The valve assembly 338 is fitted in a void 340 defined by the cap 336. A plunger arm 344 of the valve assembly 338 is slidably centered in the void 340 by centering elements 341. A valve seat 339 attached at a top end of the plunger arm 344 seals the void 344 of the cap 336 when the valve assembly 338 is in its closed state. A biasing means 342, such as a spring for example, is disposed around the plunger arm 344 between the centering elements 341 and a contact element 343 and biases the valve assembly 338 to its closed position.

When the contact element 343 is forced up, against the force of the biasing means 342, the valve seat 339 rises and permits water in the removable water storage container 304 to flow down through the void 340.

The operation of the personal-sized warm air humidifier is described below.

The upper cover 302 is manually removed thereby exposing the top of the steam ejection tower assembly 308, the medication cup assembly 309, and the top of the water storage container 304. The water storage container 304 is then manually removed by gripping indents (not shown) in the sides of the water storage container 304 and lifting it out from the lower housing 303. The cap 337 is then removed and the water storage container 304 is filled with water. The cap 337 is then screwed back onto the water storage container 304 and the water storage container 304 is returned to the lower housing 303.

When the water storage container 304 is returned, the valve contact element 327 of the y assembly 305 contacts the contact element 343 of the valve 338 thereby actuating the valve assembly upward against the force of the biasing means 342 and lifting the valve seat 339 up from the void 344 of the cap 336.

Water then flows from the water storage container 304 into the filling compartment 325 of the tray assembly 305. The level of the water is defined by the top of the cap 336 since no air can flow into the water storage container 304 through the cap 336 when it becomes covered with water. The water flows from the filling compartment 325 to the evaporation compartment 326 via the void in the lower portion of the dividing wall 324.

Water in the evaporation compartment 326 is heated by heating element 306 thereby producing steam and creating a higher pressure in the evaporation chamber. This higher pressure forces the level of the water in the evaporation chamber 326 to be lower than that in the filling chamber 325. This higher pressure also forces the steam through the steam nozzle 331 of the steam nozzle assembly 307. In the steam ejection tower assembly 308, this steam draws cooler air as described above.

The dividing wall 324 minimizes heat transfer from the water in the evaporation compartment 326 to the water in the filling compartment 325. The water channel lengthening wall 328 lengthens the water channel between the void in the dividing wall 324 and the cap 336 of the storage container 304 thereby minimizing heated water and heat transfer from the void to water stored in the water storage container 304. Further, the lengthened section 370' of the skirt 370 provides a physical barrier which impedes pulses of hot water from traveling, unobstructed, from the heating element 306 to the void formed in the dividing wall 324. Thus, only a small amount of water is heated thereby promoting safety in the event Of a spill and promoting quick start-up time.

If the water level becomes too low, the temperature of the heating element 306 will rise since cooler water is no longer being supplied. When the temperature of the heating element reaches a predetermined temperature, a thermostatic switch 360 will trip and turn off the heating element. The thermostat switch 360 can be reset by the resetting assembly 317 by pressing the plunger 319 in y causing the sloped surface 320 of the plunger 319 to reset the thermostatic switch 360.

Figure 13:
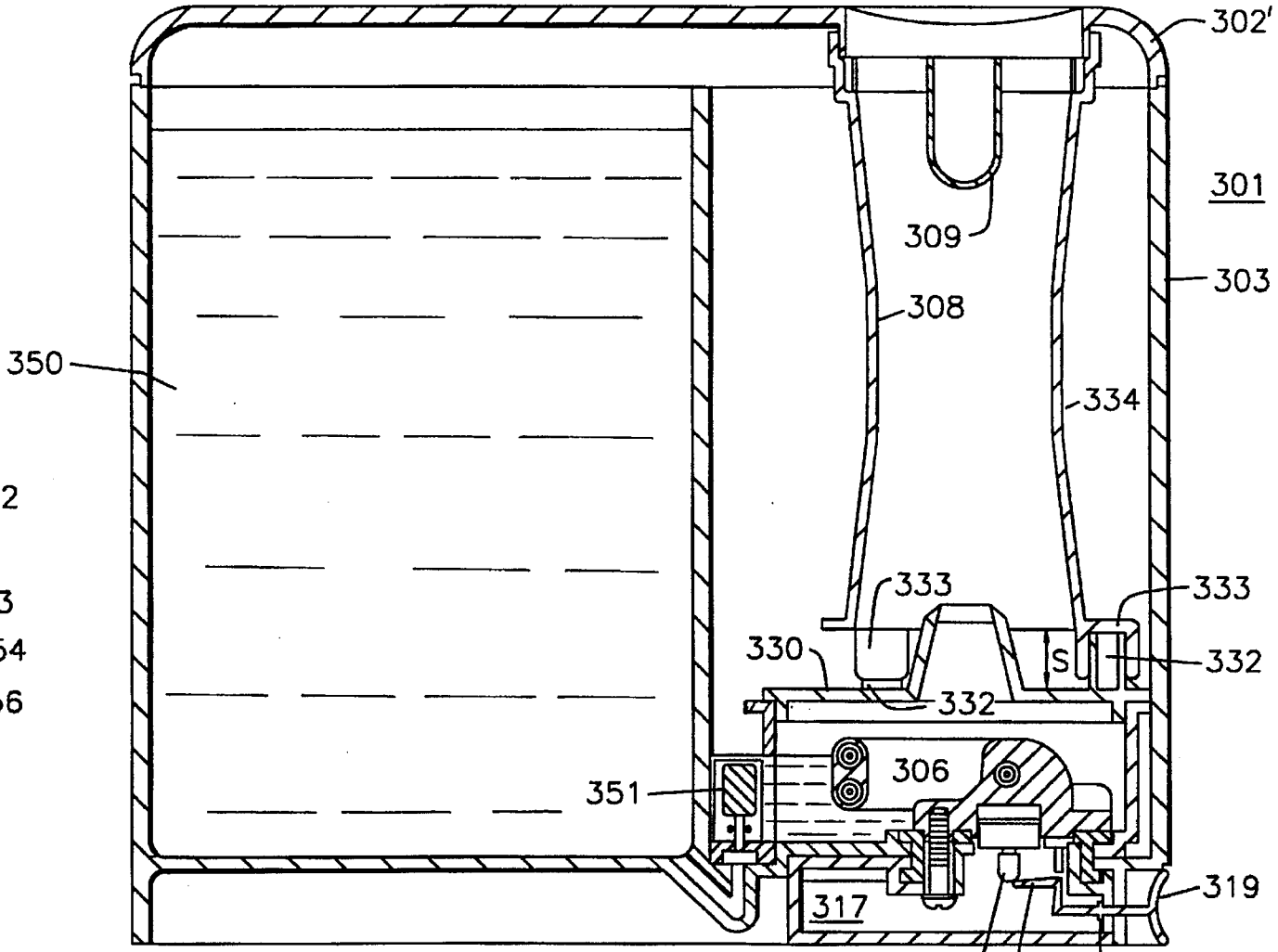
FIG. 13 is a cross-sectional front view of a personal-sized warm air humidifier having a fixed internal water container.
Figure 18:
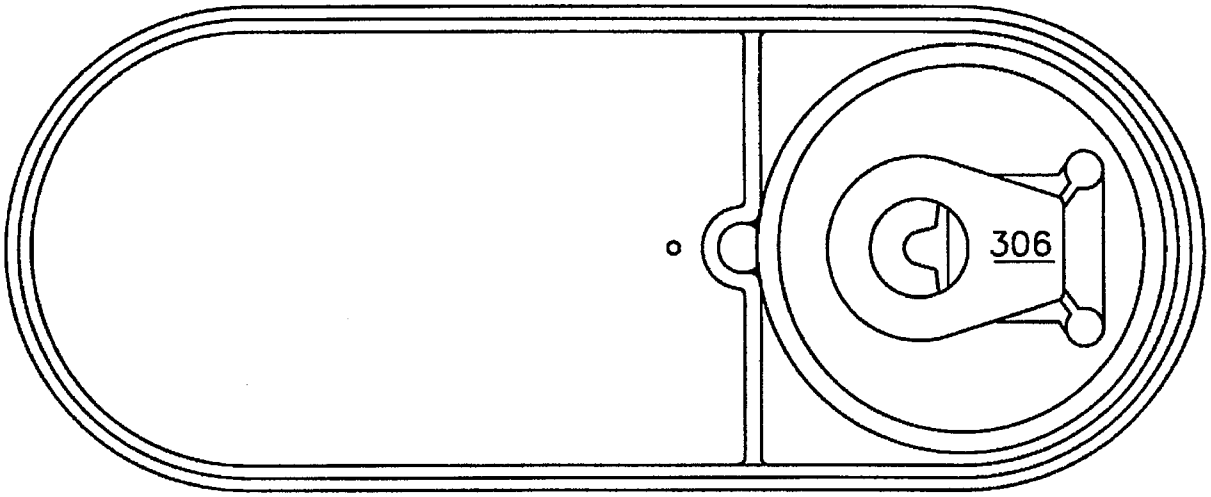
FIG. 18 illustrates a top view of the personal-sized warm air humidifier of FIG. 13 with the cover removed.

A side cross-section of the embodiment of the personal-sized warm air humidifier having a fixed internal water container 350 is illustrated in FIG. 13. A top view of this embodiment with the upper cover 302 removed is illustrated in FIG. 18.

Figure 14:
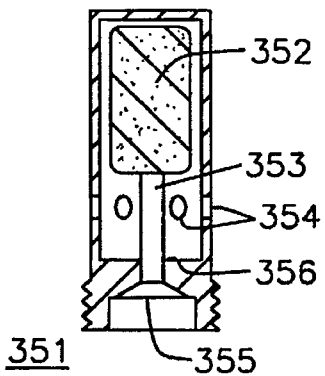
FIG. 14 is an enlarged cross sectional view of a float valve employed in the personal-sized warm air humidifier illustrated in FIG. 13.

In place of the tray assembly 305 and removable water storage container 304, a removable float valve 351 is provided. As illustrated in FIG. 14, the float valve 351 includes a stem 353 having a float 352 on an upper end and a valve seat 355 on a lower end. Water flows up through the void 356 and out openings 354 until the water level rises to such an extent that the float 352 pulls the valve seat 355 upward thereby sealing the void 356.

Further, as can be seen when comparing FIG. 12 with FIG. 13, the personal-sized warm air humidifier having a fixed water container 350 illustrated in FIG. 13 may have a smaller upper cover 302 and a larger lower housing 303 than the embodiment illustrated in FIG. 12.

The operation of the personal-sized warm air humidifier having a fixed water container 350 otherwise operates similarly to the personal-sized warm air humidifier of FIG. 12 described above.

Figure 15:
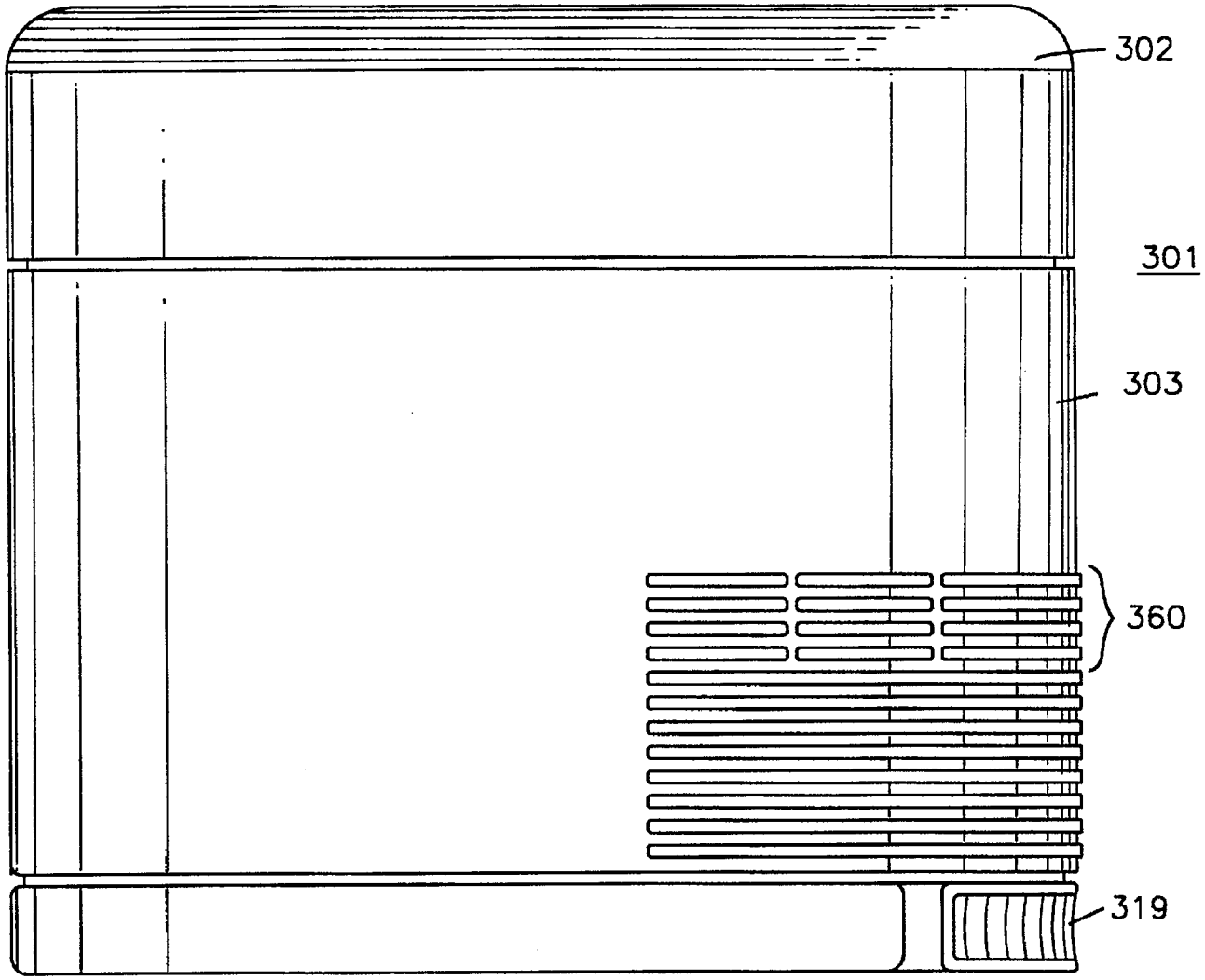
FIG. 15 illustrates a front of a shell accommodating elements of a personal-sized warm air humidifier.
Figure 16:
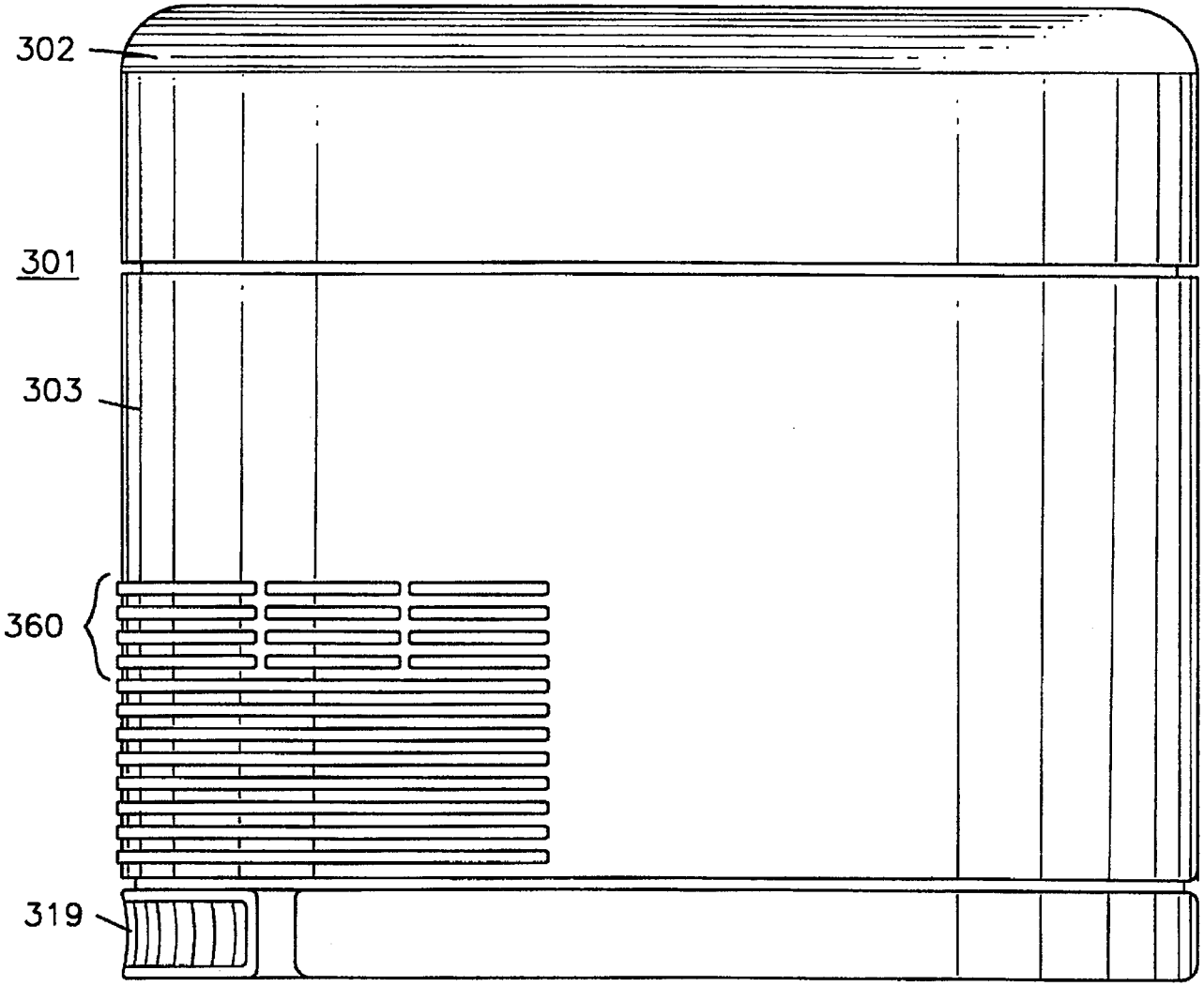
FIG. 16 illustrates a back of the shell of FIG. 15.

FIG. 15 is a front view, and FIG. 16 is a rear view, of the shell 301 of the personal-sized warm air humidifier of FIG.

12 or FIG. 13. As shown, the lower housing 303 includes an air inlet grille 360 which permits air to be drawn into the shell 301 between the steam nozzle assembly 307 and the steam ejection tower 308. The lines beneath the inlet grille 360 have no function but are merely provided for aesthetic purposes.

Figure 20:
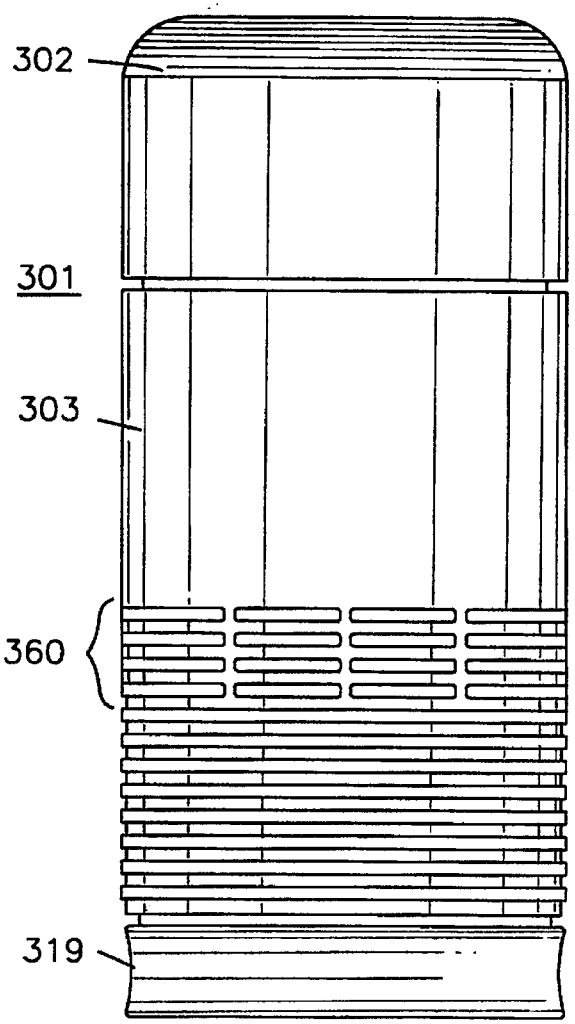
FIG. 20 illustrates a right side view of a shell accommodating elements of a personal-sized warm air humidifier.
Figure 19:
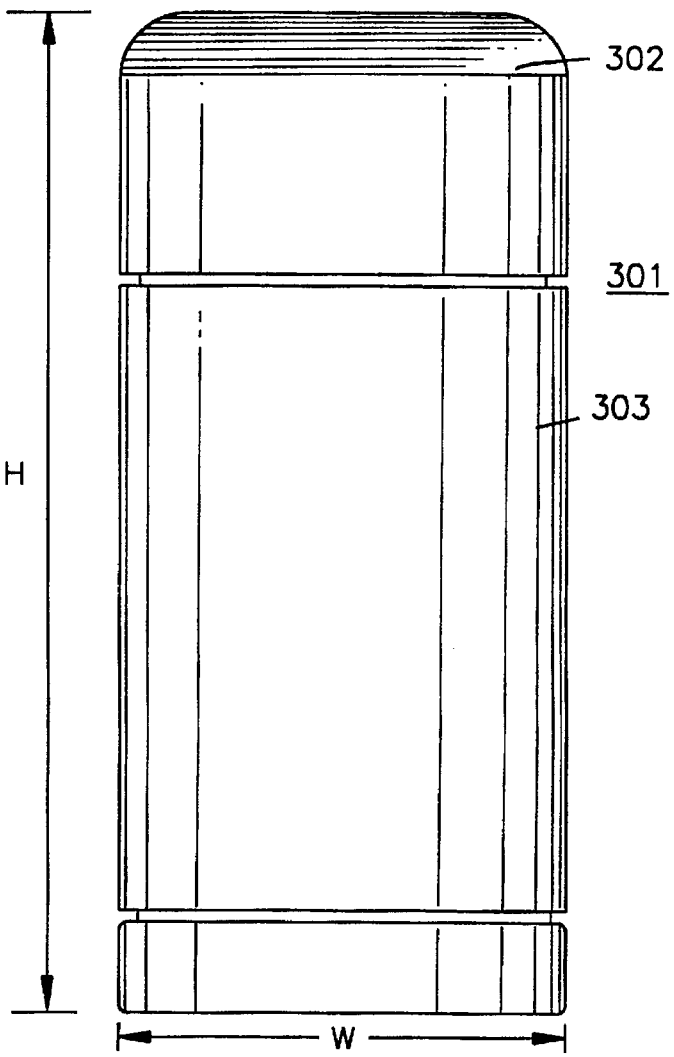
FIG. 19 illustrates a left side view of a shell accommodating elements of a personal-sized warm air humidifier.

FIG. 19 is a left side view, and FIG. 20 is a right side view, illustrating the shell 301 of the personal-sized warm air humidifier of FIG. 12 or FIG. 13. As shown in FIG. 20, the lower housing 303 includes the air inlet grille 360. The lines beneath the inlet grille 360 have no function but are merely provided for aesthetic purposes.

Further, as shown in FIG. 19, the height H of the warm-air humidifier is at least twice its width W. In a preferred embodiment, the height is at least 9.5 inches and the width is less than 4.1 inches. In a preferred embodiment, the height H is approximately 9.63 inches while the width W is approximately 4 inches. The minimum 2 to 1 ratio between height and width provides an adequate height for mixing steam with air and a compact width.

Figure 21:
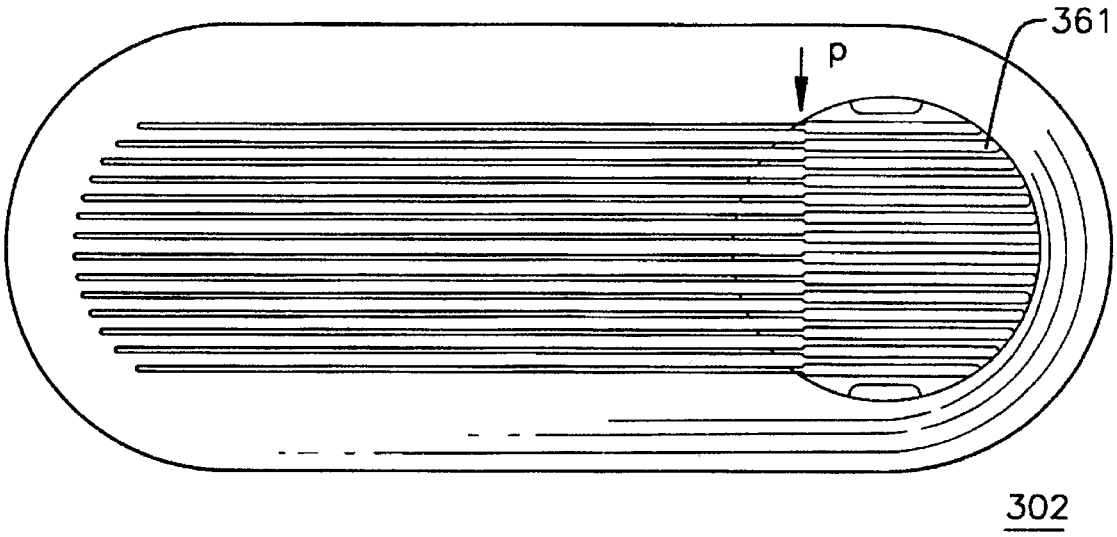
FIG. 21 illustrates a top view of a cover of a personal-sized warm air humidifier.

FIG. 21 is a top view illustrating the top cover 302 of the personal-sized warm air humidifier of FIG. 12 or FIG. 13. As shown, the top cover 302 includes an outlet grille situated above the steam ejection tower 308. The lines to the right of point "P" have no function but are merely provided for aesthetic purposes.

Steam ejector tube 84 preferably is in the configuration disclosed in the drawings although the present invention contemplates the usage of a steam ejector tube which is straight or angled (rather than curved) or which does not have a restricted throat portion. However, these variations would result in a loss of efficiency of tube 84 as would be understood from points 1, 2, and 3 in the "Summary of the Invention".

The present invention also contemplates an evaporation chamber in which the lower wall engages the bottom of the tray rather than spaced therefrom. In such an event, openings would be provided circumferentially of the lower wall to permit water to enter the evaporation chamber from the main compartment. Although the operation of the humidifier of the present invention would not materially change,a problem would arise in that the openings, in time, would become clogged by deposits from the water or other liquids used, to thereby impede the flow of water between the main compartment and the evaporation chamber.

From the foregoing, it is apparent that the present invention provides an improved and novel humidifier which utilizes a simple and effective steam ejector tube in combination with a steam nozzle through which a high velocity jet is produced under the constant pressure by reason of a differential head of water in the water supply compartment as constituted by the main compartment and the filling compartment of the base.

By utilizing the phenomena of entrainment, negative pressure and buoyance a uniform and desired mixture of steam and air at a temperature below the painful range is obtained without the use of relatively expensive motor driven blowers and the like, as well as components with moving parts. The invention thus obviates the need of fans, motors, electric controls and the like, and the assembly costs required of them as well as maintenance costs. Furthermore, the pressure drop through the air filter, where used, is overcome by the present invention which adds to the value of same.

By providing an outer shell to accommodate all elements, an easily transportable personal-size warm air humidifier is possible. While the chances of tipping are increased by the height-to-width ratio, by only heating a small amount of water, safety is increased.

Although several embodiments of the present invention have been disclosed and described herein, it may be readily understood that other variations of the invention may be practiced which still will be embraced by the spirit of the invention and covered by the claims which follow.

What is claimed is:

1. A portable warm-air humidifier comprising:

a) a water reservoir;

b) an evaporation compartment fluidly coupleable with the water reservoir;

c) a venturi nozzle assembly arranged adjacent to the evaporation compartment;

d) a mixing chamber arranged adjacent to the venturi nozzle assembly; and e) a shell, the shell i) having a first portion including a base which accommodates the evaporation compartment, ii) having a second portion, the second portion being removeably fitted to the first portion, and iii) enclosing each of the water reservoir, the evaporation compartment, the venturi nozzle, and the mixing chamber, wherein the venturi nozzle assembly includes a skirt extending in a direction opposite to the direction of the venturi nozzle, and wherein the skirt of the venturi nozzle assembly fits within the evaporation compartment to form an evaporation chamber; and wherein the skirt of the venturi nozzle assembly has an extended portion for preventing heated water in the heating chamber from returning to the water reservoir.

2. The portable warm-air humidifier of claim 1 wherein the evaporation compartment includes a free standing heating element mounted to the base.

3. The portable warm-air humidifier of claim 1 further comprising means for maintaining a water level in the evaporation chamber above a bottom of the skirt, whereby any seam generated in the boiling chamber is forced through the venturi nozzle.

4. The portable warm-air humidifier of claim 1 wherein the first portion of the shell includes an open end and wherein the second portion of the shell includes a flange which fits within the open end of the first portion.

5. The portable warm-air humidifier of claim 4 wherein the fit between the flange of the second portion and the open end of the first portion is a friction fit.

6. The portable warm-air humidifier of claim 1 wherein the first portion of the shell includes a water channel lengthening wall which fluidly couples the heating cavity with the water reservoir.

7. The portable warm-air humidifier of claim 1 wherein the mixing chamber is separated from the venturi nozzle assembly by a predetermined space, thereby permitting external air to mix with any effluent from the venturi nozzle in the mixing chamber.

8. The portable warm-air humidifier of claim 7 wherein the shell includes at least one aperture adjacent to the predetermined space.

9. The portable warm-air humidifier of claim 1 wherein the mixing chamber includes a first open end arranged adjacent to the venturi nozzle and a second open end arranged opposite of the first open end, and wherein the second portion of the shell includes at least one aperture adjacent to the second open end of the mixing chamber.

10. The portable warm-air humidifier of claim 1 wherein steam nozzle assembly includes means for permitting condensed water to return to the heating cavity.

11. The portable warm-air humidifier of claim 1 further comprising a power cord for supplying power, wherein the first portion of the shell includes a recess for storing the power cord.

12. The portable warm-air humidifier of claim 1 wherein the venturi nozzle assembly and the mixing chamber are removeable, thereby permitting access to the heating cavity.

13. A portable warm-air humidifier comprising:

a) an evaporation compartment;

b) an evaporation compartment fluidly coupleable with the water reservoir;

c) a venturi nozzle assembly arranged adjacent to the evaporation compartment;

d) a mixing chamber arranged adjacent to the venturi nozzle assembly; and e) a shell, the shell i) having a first portion including a base which accommodates the evaporation compartment and which includes an integral water reservoir which is fluidly coupleable with the evaporation compartment, ii) having a second portion, the second portion being removeably fitted to the first portion, and iii) enclosing each of the evaporation compartment, the venturi nozzle, and the mixing chamber, wherein the evaporation compartment includes a free standing heating element mounted to the base, and wherein the venturi nozzle assembly includes a skirt extending in a direction opposite to the direction of the venturi nozzle, and wherein the skirt of the venturi nozzle assembly fits within the evaporation compartment to form an evaporation chamber, and wherein the skirt of the venturi nozzle assembly has an extended portion for preventing heated water in the heating chamber from returning to the water reservoir.

14. The portable warm-air humidifier of claim 13 further comprising means for maintaining a water level in the boiling chamber above a bottom of the skirt, whereby any steam generated in the boiling chamber is forced through the venturi nozzle.

15. The portable warm-air humidifier of claim 13 wherein the first portion of the shell includes an open end and wherein the second portion of the shell includes a flange which fits within the open end of the first portion.

16. The portable warm-air humidifier of claim 15 wherein the fit between the flange of the second portion and the open end of the first portion is a friction fit.

17. The portable warm-air humidifier of claim 13 wherein the first portion of the shell includes a float valve which permits the heating cavity to be fluidly coupled with the water reservoir.

18. The portable warm-air humidifier of claim 13 wherein the mixing chamber is separated from the venturi nozzle assembly by a predetermined space, thereby permitting external air to mix with any effluent from the venturi nozzle in the mixing chamber.

19. The portable warm-air humidifier of claim 18 wherein the shell includes at least one aperture adjacent to the predetermined space.

20. The portable warm-air humidifier of claim 13 wherein the mixing chamber includes a first open end arranged adjacent to the venturi nozzle assembly and a second open end arranged opposite of the first open end and wherein the second portion of the shell includes at least one aperture adjacent to the second open end of the mixing chamber.

21. The portable warm-air humidifier of claim 13 wherein the steam nozzle assembly includes means for permitting condensed water to return to the heating cavity.

22. The portable warm-air humidifier of claim 13 further comprising a power cord for supplying power, wherein the first portion of the shell includes a recess for storing the power cord.

23. The portable warm-air humidifier of claim 13 wherein the venturi nozzle assembly and he mixing chamber are removeable, thereby permitting access to the heating cavity.

* * * * *